US010780022B2

(12) United States Patent
Terhune et al.

(10) Patent No.: US 10,780,022 B2
(45) Date of Patent: Sep. 22, 2020

(54) MEDICATION PACKAGING AND DOSE REGIMEN SYSTEM

(71) Applicant: MYLAN INC., Canonsburg, PA (US)

(72) Inventors: Joanna Terhune, Pittsburgh, PA (US); Jeffrey Warden, Bala Cynwyd, PA (US); Chad Holland, Wexford, PA (US)

(73) Assignee: Mylan Inc., Canonsburg, PA (US)

( * ) Notice: Subject to any disclaimer, the term of this patent is extended or adjusted under 35 U.S.C. 154(b) by 743 days.

(21) Appl. No.: 15/504,559

(22) PCT Filed: Aug. 18, 2015

(86) PCT No.: PCT/US2015/045644
§ 371 (c)(1),
(2) Date: Feb. 16, 2017

(87) PCT Pub. No.: WO2016/028747
PCT Pub. Date: Feb. 25, 2016

(65) Prior Publication Data

US 2017/0239144 A1 Aug. 24, 2017

Related U.S. Application Data

(60) Provisional application No. 62/039,144, filed on Aug. 19, 2014, provisional application No. 62/039,152,
(Continued)

(51) Int. Cl.
*A61J 7/00* (2006.01)
*B65D 83/04* (2006.01)
(Continued)

(52) U.S. Cl.
CPC ..... *A61J 7/0084* (2013.01); *A61J 1/035* (2013.01); *A61J 7/0076* (2013.01); *A61J 7/04* (2013.01);
(Continued)

(58) Field of Classification Search
CPC ..... A61J 7/0084; A61J 7/04; A61J 7/0076; A61J 1/035; A61J 2205/30; B65D 83/0463
(Continued)

(56) References Cited

U.S. PATENT DOCUMENTS 2,335,016 A 4/1942 Lorenzen et al.
3,954,179 A * 5/1976 Warmath ..... B65D 43/162 206/528
(Continued)

FOREIGN PATENT DOCUMENTS

JP H105312 A 1/1998
JP 2003054599 A 2/2003
(Continued)

OTHER PUBLICATIONS

Petty, et al. Planning for discharge: the next step for medicines reconciliation. The Pharmaceutical Journal, May 7, 2010, retrieved from the Internet on Feb. 16, 2017 at website: http://www.pharmaceutical-journal.com/opinion/comment/planning-for-discharge-the-next-step-for-medicines-reconciliation/11010072.article, entire article.
(Continued)

*Primary Examiner* — Chun Hoi Cheung
*Assistant Examiner* — Brijesh V. Patel
(74) *Attorney, Agent, or Firm* — Sorell, Lenna & Schmidt LLP; William D. Schmidt, Esq.

(57) ABSTRACT

A medicament dispensing container comprises a first wall and a second wall defining a cavity therebetween. At least one member is connected to at least one of the walls and is disposable in the cavity. The at least one member defines at least one dose receptacle configured for disposal of at least one dose of at least one medication. The at least one member includes indicia relating to a medication regimen comprising the at least one medication. The walls are movable between
(Continued)

a medication accessible configuration and a tamper resistant configuration. Systems and methods of use are disclosed.

12 Claims, 40 Drawing Sheets

Related U.S. Application Data filed on Aug. 19, 2014, provisional application No. 62/039,201, filed on Aug. 19, 2014.

(51) Int. Cl.
*A61J 1/03* (2006.01)
*A61J 7/04* (2006.01)

(52) U.S. Cl.
CPC ..... *B65D 83/0463* (2013.01); *A61J 2205/30* (2013.01)

(58) Field of Classification Search
USPC ..... 206/538, 531, 528, 534, 1.5, 472
See application file for complete search history.

(56) References Cited

U.S. PATENT DOCUMENTS 4,889,238 A * 12/1989 Batchelor ..... B65D 43/169 206/535
5,033,634 A * 7/1991 Batchelor ..... B65D 50/045 220/281
5,240,113 A 8/1993 Gibilisco
5,267,668 A * 12/1993 Jones ..... A61F 17/00 206/363
5,711,417 A * 1/1998 Tilve ..... A45C 11/04 206/6
5,740,938 A * 4/1998 Hofmann ..... B65D 43/162 206/531
5,782,359 A 7/1998 McAllister et al.
6,173,838 B1 * 1/2001 Brozell ..... B65D 77/02 206/472
6,708,826 B1 * 3/2004 Ginsberg ..... B65D 33/001 206/425
6,832,686 B2 * 12/2004 Donegan ..... B65D 77/02 206/1.5
6,953,131 B2 * 10/2005 Devine ..... B65D 83/0409 221/246
7,549,541 B2 * 6/2009 Brozell ..... B65D 83/0463 206/531
7,621,399 B2 * 11/2009 Nakajo ..... G03B 42/04 206/1.5
7,661,534 B2 * 2/2010 Saclier ..... B65D 75/5805 206/535
7,780,037 B2 * 8/2010 Corbellini ..... A45D 33/006 220/811
8,066,122 B2 * 11/2011 Beecroft ..... B65D 83/0463 206/1.5
8,689,978 B2 * 4/2014 Flood ..... A61J 1/03 206/531
8,708,149 B2 * 4/2014 Hawry ..... B65D 25/10 206/535
9,375,383 B1 * 6/2016 Wang ..... A61J 7/0076
2003/0234195 A1 12/2003 Earl et al.
2004/0045858 A1 * 3/2004 Harrold ..... B65D 83/0463 206/470
2004/0226853 A1 * 11/2004 Intini ..... B65D 83/0463 206/536
2004/0251165 A1 12/2004 Girzaitis
2005/0051454 A1 3/2005 Coe et al.
2006/0049078 A1 3/2006 Sams et al.
2006/0157375 A1 * 7/2006 DeJonge ..... B65D 83/0463 206/535
2009/0127156 A1 * 5/2009 Tung ..... B65D 83/0463 206/531
2010/0264054 A1 10/2010 Beecroft et al.
2011/0052310 A1 3/2011 Jansen et al.

FOREIGN PATENT DOCUMENTS

JP 2013527084 A 8/2010
WO 2013030697 A 3/2013

OTHER PUBLICATIONS

International Search Report and Written Opinion of the International Searching Authority (ISA/US) dated Nov. 3, 2015 of International PCT Application No. PCT/US2015/045644 filed on August 18, 2015, entire document.
International Search Report and Written Opinion of the International Searching Authority (ISA/US) dated Nov. 1, 2015 of International PCT Application No. PCT/US2015/045640 filed on Aug. 18, 2015, entire document.

* cited by examiner

MEDICATION PACKAGING AND DOSE REGIMEN SYSTEM

CROSS-REFERENCE TO RELATED APPLICATION

This application claims the benefits of U.S. Provisional Patent Application No. 62/039,144 filed Aug. 19, 2014, U.S. Provisional Patent Application No. 62/039,152 filed Aug. 19, 2014 and U.S. Provisional Patent Application No. 62/039,201 filed Aug. 19, 2014, the contents of each of these applications being hereby incorporated in their respective entireties by reference.

TECHNICAL FIELD

The present disclosure generally relates to medicament packaging and more particularly to a dispensing device and system that provides a medication regimen and/or tamper resistance and a method for treatment of a medical condition.

BACKGROUND

Retail customers and/or patients can be engaged in a medical therapy, which may include diet, exercise and/or a prescription and/or a non-prescription medication dosing regimen, which may be employed to treat an illness. In some cases, hospitalized patients are often discharged and instructed by one or more medical practitioners to comply with a medical therapy.

Such medication dosing regimen can include one or a plurality of medications administered over a regimen, which may include one or more medications. The medication dosing regimen can require administration of medications simultaneously, at different times and/or according to days of a week or time of day. Such medication regimens may be administered in addition to existing medication regimens that a user may take for nutritional, therapeutic and/or illness treatment.

Such medication regimens, however, often suffer from poor patient compliance. In fact, many patients fail to comply with their medication regimens. In some cases, life-style related medications may also suffer from poor user compliance. Factors that contribute to non-compliance may include complexity of medication regimen, patient failure in filling prescriptions, incorrect order and/or prescription, cost, adverse side effects, patient reluctance, lack of motivation, non-reconciliation with existing medication and/or patient physiological issues.

Various medications of a medication regimen can be dispensed from a medication container such as single dose and/or multiple dose blister packaging to a user with or without tamper resistance. Multiple dose blister packaging can dispense a single medication according to a regimen including day, e.g., Monday, Tuesday, etc. and/or time of day. This disclosure describes an improvement over these prior art technologies.

SUMMARY

In one embodiment, a medicament dispensing container comprises a first wall and a second wall defining a cavity therebetween. At least one member is connected to at least one of the walls and is disposable in the cavity. The at least one member defines at least one dose receptacle configured for disposal of at least one dose of at least one medication.

The at least one member includes indicia relating to a medication regimen comprising the at least one medication. The walls are movable between a medication accessible configuration and a tamper resistant configuration. Systems and methods of use are disclosed.

BRIEF DESCRIPTION OF THE DRAWINGS

The present disclosure will become more readily apparent from the specific description accompanied by the following drawings, in which.

DETAILED DESCRIPTION

Figure 1:
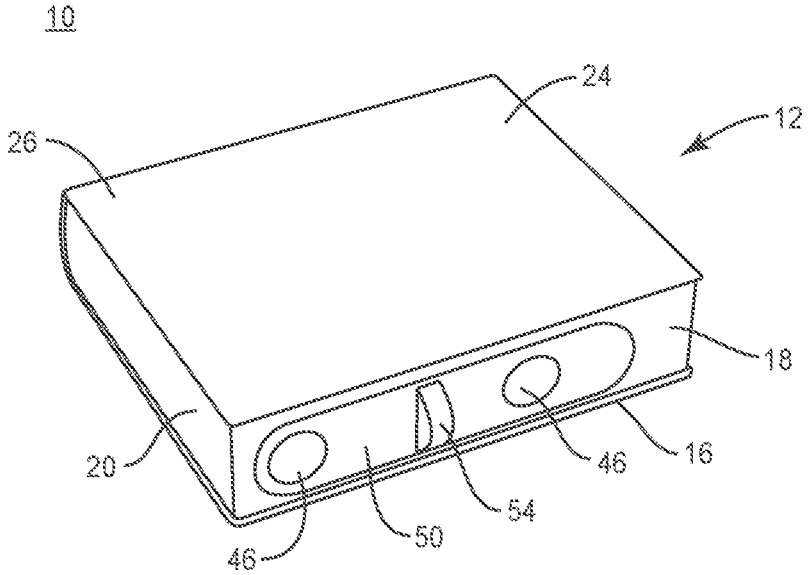
FIG. 1 is a perspective view of components of one embodiment of a system in accordance with the principles of the present disclosure.

The exemplary embodiments of a medicament dispensing system and related methods of use disclosed are discussed in terms of dispensing devices for the treatment of various diseases, illness and/or ailments and more particularly, in terms of a medicament dispensing device and system that provides a medication regimen and/or tamper resistance and a method for treatment of a medical condition. In some embodiments, the medicament dispensing system is employed with a method for distribution of medication packaging to a patient for treatment of one or more diseases, illness and/or ailments. In some embodiments, the medicament dispensing system is employed with a method such that a patient is discharged from a health care facility, for example, short term discharge and/or long term discharge.

In one embodiment, the medicament dispensing system is employed with a method such that a patient is discharged from a health care facility, such as, for example, a hospital after one or more diseases, illness and/or ailments, such as, for example, myocardial infarction and may be prescribed one or more medications. In some embodiments, a patient may be directed and/or prescribed medication, such as, for example, an antiplatelet agent, aspirin, a beta-blocker, an ACE inhibitor, an ARB statin, nitro-glycerin, a docusate and/or anti-depressants. In some embodiments, the medicament dispensing system is employed to avoid failure of a patient to comply with such regimens and/or to take medications as prescribed or directed. In some embodiments, compliance failure can include the patient failing to refill the prescription, forgetting to take the prescribed medication, incomplete dosage and/or taking the medication at the incorrect time. In some embodiments, the medicament dispensing system is employed with a method for chronic dosing, for example, 30 day scripts or 90-100 day mail order refills. In some embodiments, the medicament dispensing system is employed with a method to facilitate compliance. In some embodiments, the medicament dispensing system is employed with a method to display and/or prove compliance. For example, a patient attending a practitioner appointment provides a present system, such as, for example, a compliance pack and displays and/or shows the practitioner use of the compliance pack, which may include rupture of one or more blister packs to evidence compliance, as described herein. In some embodiments, the medicament dispensing system is employed with a method for distribution of medication packaging to a patient for treatment of one or more diseases, illness and/or ailments, such as, for example, pneumonia, heart failure, pain, infectious diseases that may include administration of medications, such as, for example, anti-retrovirals (ARV) for treatment of HIV/AIDS, dyslipidemia (high cholesterol), hypertension (high blood pressure), metabolic syndrome/insulin intolerance related to diabetes, psychological diseases and/or administration of transplant/anti-rejection drugs.

In some embodiments, the medicament dispensing system comprises a medicament dispensing system and methods of use for storage, transportation and discharge of medications for the treatment of a medical condition. In some embodiments, the medicament dispensing system comprises a medicament dispensing system and methods of use for storage, transportation and discharge of medications including those for treating illnesses, such as, for example, elevated blood pressure, dyslipidemia (high cholesterol), diabetes, metabolic syndrome, heart failure, pneumonia, cardiac deficiencies, arthritis, illnesses in which pain is part of an on-going treatment plan, and/or life-style related medications such as, for example, birth control pills, hormone replacement pills and nutritional supplements, such as, for example, neutraceuticals, for example, having vitamin A, D, and E with a calcium supplement. In some embodiments, the method includes treatment of a heart condition following a myocardial infarction. In one embodiment, the medicament dispensing system and methods of the present disclosure are employed to aid a person with a medical condition requiring administration of multiple pills, doses or schedules as part of a regimen. In one embodiment, the medicament dispensing system and methods of the present disclosure include a medicament dispensing device that provides tamper resistance, such as, for example, child resistance, while being easily accessed by an adult.

In one embodiment, a medication container may include multiple medications on a blister card. In one embodiment, the medicament dispensing system provides a complex dosage regimen for medications for a period of time, such as, for example, two weeks. In some embodiments, one or more blister cards are provided pre-filled with medication, as described herein, from a manufacturer. In some embodiments, a practitioner, such as, for example, a pharmacist determines and selects one or more of the pre-filled blister cards based on a doctor's prescription and creates the medication container. In some embodiments, the manufacturer provides a medication container packed with selected blister cards and pre-filled medication according to the doctor's prescription. In some embodiments, the complex dosage regimen for the medications is provided for a period lasting until a patient's first outpatient visit following release from a hospital. In one embodiment, one or more medications are included in a medicament dispensing system. In one embodiment, medications prescribed to a patient following a medical procedure are included in a medicament dispensing system. In one embodiment, medications previously being taken by a patient are included in a medicament dispensing system.

In one embodiment, the medication container includes two small organizers, such as, for example, a week one and a week two. In one embodiment, each organizer contains a tri-fold drug card including one week of therapy. In one embodiment, the organizers include a child resistant lock, such as, for example, two white plastic pieces on the outside of the organizer configured in a push and slide configuration.

In one embodiment, the medication container includes a simple child resistant non-collapsible box filled with punch cards. In one embodiment, the medication container includes pharmacist insert strips of blisters and seal cards. In one embodiment, the medication container organizes medicines by week and/or by day. In one embodiment, the medication container includes a simpler user interface. In one embodiment, the medication container includes a system to easily track medicine dosage compliance. In one embodiment, the medication container is manufactured with minimal material to reduce cost. In one embodiment, the medication container is configured to include various educational material and/or blister cards.

In one embodiment, the medicament dispensing system provides a complex dosage regimen for medications for a period of time, such as, for example, two weeks. In some embodiments, the complex dosage regimen for the medications is provided for a period lasting until a patient's first outpatient visit following release from a hospital. In one embodiment, one or more medications are included in a medicament dispensing system. In one embodiment, medications prescribed to a patient following a medical procedure are included in a medicament dispensing system. In one embodiment, medications previously being taken by a patient are included in a medicament dispensing system.

In some embodiments, the medicament dispensing system comprises medication packaging that includes one or more medications. In some embodiments, the medication packaging includes a member, such as, for example, a unit dose page including indicia. In some embodiments, the indicia includes information regarding medication and dosages required by a prescribed and/or non-prescribed regimen. In some embodiments, the indicia includes a description of medication, which may include a name of a drug and a medical effect of a drug. In one embodiment, the unit dose page may include indicia that represent other medications or dosages to accommodate patients as needed. In one embodiment, the unit dose page may include space for adding indicia that represent other medications or dosages to accommodate patients as needed. In one embodiment, the indicia are screen printed on the unit dose page. In one embodiment, the indicia are hand written on the unit dose page.

In some embodiments, the medicament dispensing system is partially or entirely filled and packaged by a pharmacist. In some embodiments, the medicament dispensing system comprises a resilient material, such as, for example, cardboard. In some embodiments, the medicament dispensing system provides a child-resistant package while being easily accessible by an adult. In some embodiments, a method for accessing medication within the medicament dispensing system is provided. In some embodiments, the method includes the step of requiring consecutive and/or simultaneous motions difficult for children to perform but simple for an adult to perform. In one embodiment, the medication packaging comprises a slidable locking mechanism. In some embodiments, the locking mechanism is movable between a non-locked position and a locked position. In some embodiments, the locking mechanism provides audible indication of movement between a non-locked position and a locked position.

In one embodiment, the medicament dispensing system includes a medication treatment regimen comprising a plurality of medications. In one embodiment, the medicament dispensing system provides an organization of each medication in a patient's treatment regimen. In one embodiment, each distinct medication in the regimen is stored on separate unit dose pages contained in a medicament packaging container. In one embodiment, the medicament dispensing system is employed with a method that includes fourteen days of therapy provided on each unit dose page. In one embodiment, medication packaging includes one or more unit dose pages assembled, filled and sealed by a pharmacist. In one embodiment, the medicament packaging container is child resistant and the unit dose pages are not child resistant.

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. In some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

As used in the specification and including the appended claims, "treating" or "treatment" of a disease or condition may include administering one or more medications to a patient (human or other mammal). Alleviation can occur prior to signs or symptoms of the disease or condition appearing, as well as after their appearance. Thus, treating or treatment includes preventing or prevention of disease or undesirable condition (e.g., preventing the disease from occurring in a patient, who may be predisposed to the disease but has not yet been diagnosed as having it). In addition, treating or treatment does not require complete alleviation of signs or symptoms, does not require a cure, and specifically includes procedures that have only a marginal effect on the patient. Treatment can include inhibiting the disease, e.g., arresting its development, or relieving the disease, e.g., causing regression of the disease. For example, treatment includes, but is not limited to, reducing acute or chronic inflammation, inducing an anti-platelet effect, reducing hypertension, and lowering cholesterol.

In some embodiments, a biologically-active substance includes any substance or substances comprising a medicament, medication or drug including an active therapeutic substance, metabolite, hormone, steroid, vitamin, fatty acid, amino acid, sugar, carbohydrate, polypeptide or mineral. In some embodiments, a biologically-active substance includes any substance used for treatment, prevention, diagnosis, cure or mitigation of disease or illness. In some embodiments, a biologically-active substance includes any substance that affects anatomical structure or physiological function. In some embodiments, a biologically-active substance includes any substance that alters the impact of external influences on an animal, or metabolite thereof. In some embodiments, a complex dosing regimen includes a systematic administration of multiple dosage units at designated times during the day. In some embodiments, a dose includes each individual release of substance into body tissue.

The following discussion includes a description of a medicament dispensing system including a medicament dispensing container, related components and methods of employing the medicament dispensing system. Alternate embodiments are also disclosed. Reference is made in detail to the exemplary embodiments of the present disclosure, which are illustrated in the accompanying figures. Turning to FIGS. 1-8, there are illustrated components of a medicament dispensing system 10.

The components of medicament dispensing system 10, individually or collectively, can be fabricated from materials suitable for storage and dispensing of medication. In some embodiments, such materials include metals, ceramics, synthetic polymers such as thermoplastics, semi-rigid and rigid materials, elastomers, fabric and/or their composites. Various components of medicament dispensing system 10 may have material composites, including the above materials, to achieve various desired characteristics such as strength, rigidity, elasticity, compliance, and durability. The components of medicament dispensing system 10, individually or collectively, may also be fabricated from a heterogeneous material such as a combination of two or more of the above-described materials. The components of medicament dispensing system 10 may be monolithically formed, integrally connected or include fastening elements and/or instruments, as described herein.

Medicament dispensing system 10 includes a medicament dispensing device, such as, for example, a medicament dispensing container 12. Medicament dispensing container 12 includes a wall, such as, for example, a pocket 14 and a wall, such as, for example, a cover 24. Pocket 14 includes a bottom section 16, a front sidewall 18, and opposing sidewalls 20. In one embodiment, bottom section 16 comprises a rectangular shape. Sidewalls 20 are disposed on opposing sides of bottom section 16 such that sidewall 18 extends between sidewalls 20.

Cover 24 includes a top section 26, a front sidewall 28, and opposing sidewalls 30. Sidewalls 30 are disposed on opposing sides of top section 26 such that sidewall 28 extends between sidewalls 30. In one embodiment, top section 26 comprises a rectangular shape. Pocket 14 is configured to fit inside cover 24. In some embodiments, sidewall 28 contacts sidewalls 30 to define a cavity when sidewalls 28, 30 are brought into contact with sidewalls 18, 20, as discussed herein.

Figure 2:
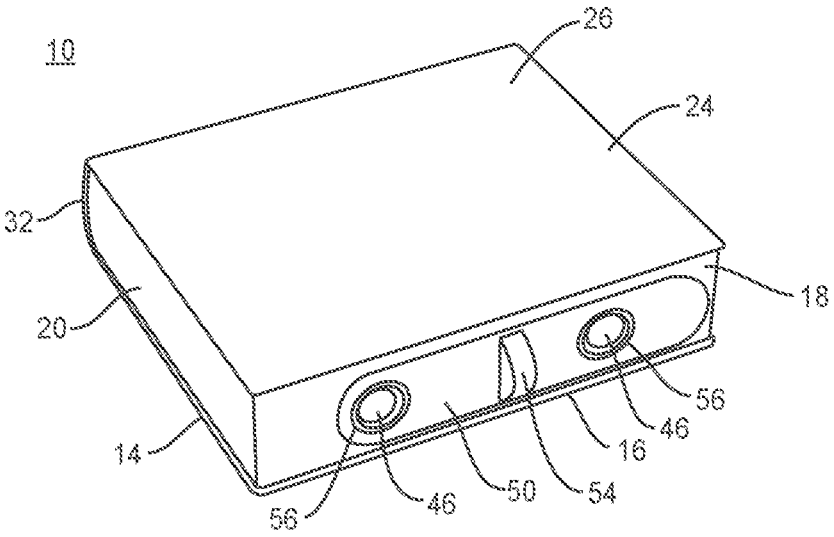
FIG. 2 is a perspective view of the components shown in FIG. 1.
Figure 3:
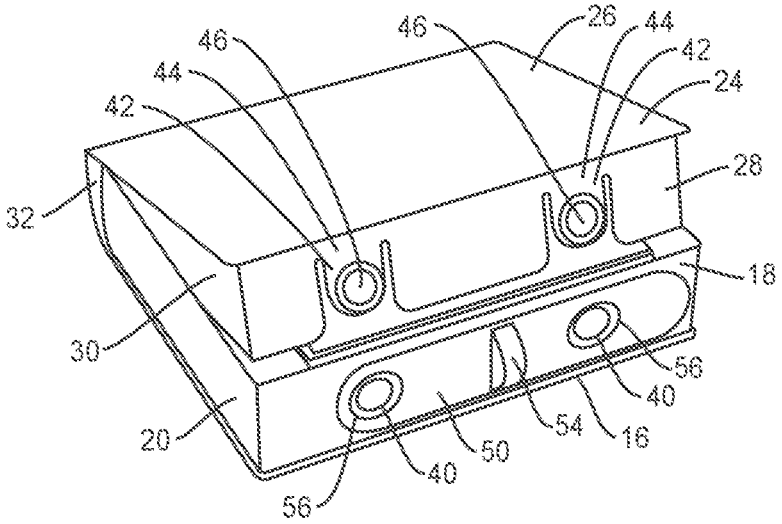
FIG. 3 is a perspective view of the components shown in FIG. 1.
Figure 4:
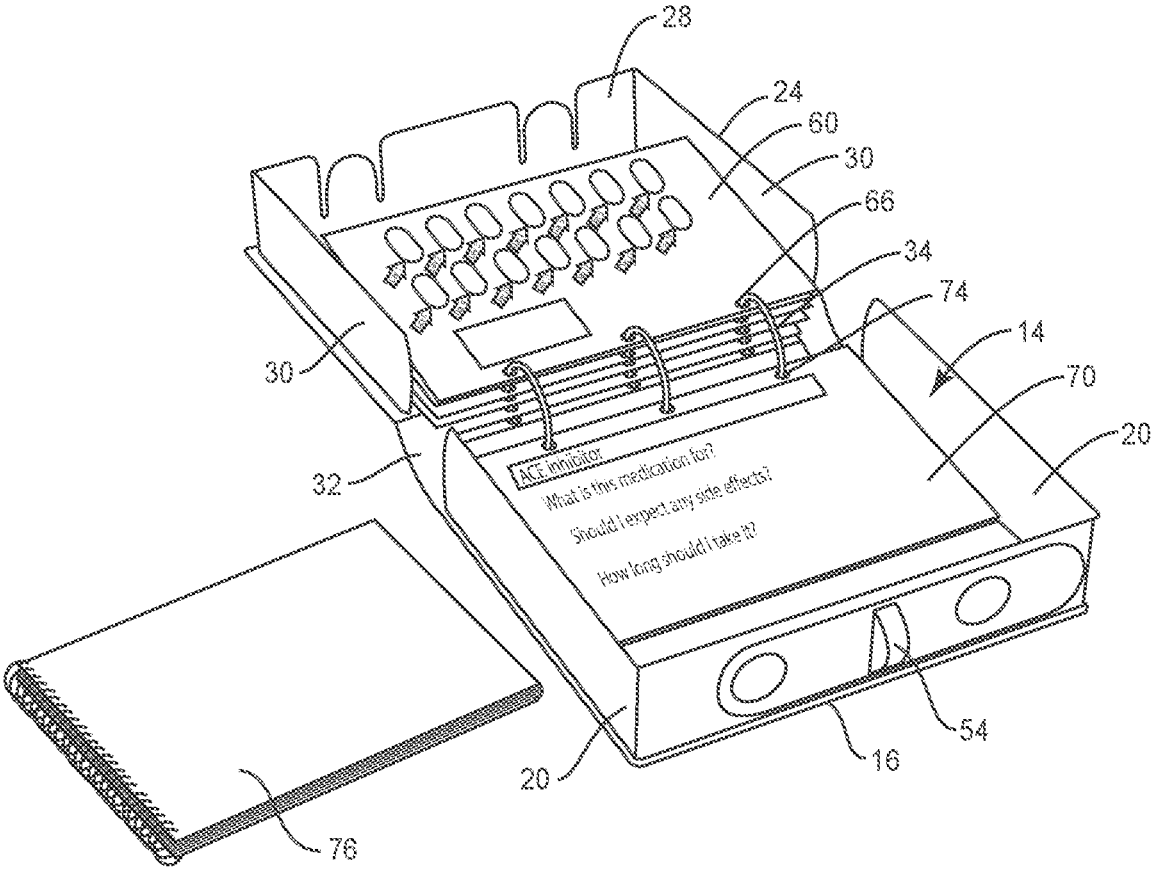
FIG. 4 is a perspective view of components of one embodiment of a system in accordance with the principles of the present disclosure.

In some embodiments, medicament dispensing container 12 includes a connecting portion, such as, for example, a spine 32. Spine 32 extends between pocket 14 and cover 24 such that cover 24 is pivotable relative to pocket 14. Cover 24 is attached to spine 32 at an end opposite sidewall 28, and pocket 14 is attached to spine 32 at an end opposite sidewall 18. Cover 24 is pivotable relative to pocket 14 between an open or non-locked configuration, such as, for example a medication accessible configuration, as shown in FIGS. 3 and 4, and a closed or locked configuration, such as, for example, a tamper resistant configuration, as shown in FIG. 1. In some embodiments, as shown in FIG. 2, medicament dispensing container 12 is disposable in a closed, locked and non-tamper resistant configuration such that a locking mechanism is aligned with a locking surface, as described herein.

In some embodiments, cover 24 is rotatable relative pocket 14 through an angular range of 0 through 360 degrees. In a closed configuration, spine 32, sidewalls 18, 20, 28, 30, and sections 16, 26 define a substantially enclosed cavity such that cover 24 and pocket 14 prevent access to contents of medicament dispensing container 12. In some embodiments, in a closed configuration, cover 24 and pocket 14 provide a child-resistant medicament dispensing container. In an open configuration, pocket 14 is rotated relative to cover 24 such that medicament dispensing container 12 rests flatly on a surface to facilitate ease of access to the contents of the cavity of medicament dispensing container 12.

In some embodiments, spine 32 comprises a coupling assembly, such as, for example, binder rings 34 configured for engagement with unit dose pages 60 and/or information inserts 70, as discussed herein. In one embodiment, binder rings 34 are configured to engage complementary openings 66 of a unit dose page 60 and/or openings 74 of an information inserts 70, as discussed herein. In some embodiments, binder rings 34 comprise rings having separable halves to facilitate assembly of unit dose pages 60 and information inserts 70, and their subsequent removal. Binder rings 34 are connected with spine 32 with a pair of rivets 38 positioned at opposite ends of binder rings 34. In some embodiments, binder rings 34 can be riveted to spine 32 by clips, screws, pins, nails, bolts, snaps or press studs. In one embodiment, when medicament dispensing container 12 is placed in a closed configuration, spine 32 conforms to the shape of binder rings 34.

Medicament dispensing container 12 includes a mechanism configured to connect pocket 14 with cover 24 for disposal of the components of medicament dispensing container 12 in a closed configuration. In one embodiment, sidewall 18 includes a surface defining one or more apertures 40. As shown in FIGS. 2 and 3, sidewall 18 includes two spaced apart apertures 40 having a circular shape. In some embodiments, aperture 40 may be oval, rectangular, polygonal, irregular, tapered, offset, staggered, uniform and non-uniform.

Cover 24 includes a mating element, such as, for example, a tab 42 configured to mate with sidewall 18 and/or apertures 40. Tab 42 extends along sidewall 28 such that tab 42 is aligned with sidewall 28. In some embodiments, tab 42 is attached to sidewall 28 via a connection point 44 adjacent top section 26. In some embodiments, tab 42 flexibly extends from connection point 44, such that tab 42 is resiliently biased to a selected configuration, as described herein.

Tab 42 defines a locking surface, such as, for example, a release button 46. Release button 46 is positioned adjacent a distal end of tab 42 and extends transversely from tab 42. In one embodiment, release button 46 has a cylindrical shape to mate with aperture 40. In some embodiments, release button 46 may include alternate shapes, such as, for example, partially cylindrical, oval, rectangular, polygonal, irregular, tapered, offset, staggered, uniform and non-uniform. In some embodiments, release button 46 may extend in alternate orientations, such as, for example, angled, offset and/or staggered.

Tab 42 is configured for resilient engagement with an inner surface of sidewall 18. As medicament dispensing container 12 is moved between an open configuration and a closed configuration, engagement of tab 42 with sidewall 18 causes tab 42 to move, flex, pivot and/or rotate about connection point 44 between a position such that tab 42 is aligned with sidewall 28 and a position such that tab 42 moves, flexes, pivots and/or rotates into aperture 40. In some embodiments, the resilient bias of tab 42 causes release button 46 to snap into aperture 40.

When moving from a closed configuration to an open configuration, the user engages release buttons 46 to translate release buttons 46 through apertures 40 out of engagement with sidewall 18. Cover 24 is rotated about pocket 14 to an open configuration of medicament dispensing container 12. In some embodiments, release buttons 46 comprise a beveled surface (not shown) adjacent a distal end of tab 42 to facilitate closing medicament dispensing container 12 from an open configuration to a closed configuration. As cover 24 is rotated toward a closed configuration, the beveled surface engages sidewall 18 to cause tab 42 to move, flex, pivot and/or rotate about connection point 44. Cover 24 is rotated toward a closed position until release buttons 46 snap into apertures 40.

In some embodiments, tab 42 is provided with indicia, such as, for example, instructions to aid a user in use of medicament dispensing container 12. The instructions may be presented in the form of a graphic, such as, for example, a bulls eye, or text, such as, for example, "push here". In some embodiments, the instructions may be printed onto a surface of release buttons 46. In some embodiments, the instructions may be printed onto sidewall 18 adjacent a slide 50, as described herein.

Medicament dispensing container 12 includes a locking mechanism, such as, for example, a slide 50. Slide 50 is disposed with sidewall 18. Slide 50 translates relative to sidewall 18 via a slot (not shown) positioned between apertures 40. The slot defines limits for translation of slide 50 along sidewall 18. Slide 50 comprises a handle 54 having a surface configured to facilitate translation by the user. In some embodiments, handle 54 may have alternate surface configurations, such as, for example, rough, arcuate, undulating, mesh, porous, semi-porous, dimpled and/or textured to facilitate gripping by a patient. Slide 50 comprises at least one window 56. Slide 50 comprises two spaced apart windows 56 configured to translate for alignment and non-alignment with apertures 40 for disposal of medicament dispensing container 12 between a locked configuration and a non-locked configuration.

Slide 50 is translatable between a locking position, as shown in FIG. 1, and a non-locked position, as shown in FIG. 2. In a locked position, slide 50 is disposed such that windows 56 and apertures 40 are disposed in non-alignment and apertures 40 are covered by slide 50. Release buttons 46 are not accessible by a user in a locked position. In a non-locked position, slide 50 is oriented such that windows 56 are aligned with apertures 40 to access release buttons 46. Release buttons 46 are accessible for engagement to release cover 24 from pocket 14 in a non-locked position.

In some embodiments, slide 50 audibly clicks to indicate a locked position. In some embodiments, slide 50 is provided with instructions to aid a patient in use of medicament dispensing container 12. In some embodiments, the instructions may be presented in the form of a graphic, such as, for example, an arrow with a lock, or text, such as, for example, "slide to unlock". In some embodiments, the instructions may be printed on slide 50. Alternatively, in some embodiments, the instructions may be printed onto sidewall 18 adjacent slide 50.

Medicament dispensing container 12 includes one or more unit dose pages 60, as shown in FIG. 4, that store and/or contain one or more medications, such as, for example, a dose of at least one medication. The dose of medication(s) is enclosed and sealed in a plurality of receptacles 62. In some embodiments, medicament dispensing container 12 includes a plurality of unit dose pages 60. In some embodiments, each unit dose page 60 encloses a different medication such that each medication that is part of a patient's dosage regimen is organized on separate unit dose pages 60. In some embodiments, unit dose page 60 comprises receptacles 62 indicating a patient's daily dosage of medication held within unit dose page 60. In some embodiments, unit dose page 60 comprises indicia 64, disposed with and displayed from a predetermined area adjacent one or more receptacles 62, indicating information regarding the medication enclosed within receptacles 62.

In some embodiments, medicament dispensing container 12 comprises a disposable dispensing device that provides therapeutic and/or nutritional support to an animal by increasing compliance with a dosing regimen, as described herein. In some embodiments, medicament dispensing container 12 and/or one or more unit dose pages 60 include blister packs, which include a plurality of receptacles 62. In some embodiments, each receptacle 62 accommodates a dosage unit and isolates that dosage unit from other dosage units. In some embodiments, a biologically-active substance within each dosage unit will not come into contact with the biologically-active substance of other dosage units.

In some embodiments, medicament dispensing container 12 and/or one or more unit dose pages 60 include a blister pack comprising at least one row of a plurality of receptacles 62 and/or areas including indicia 64. In some embodiments, each area defines at least one receptacle 62. In some embodiments, each receptacle 62 is designed to hold only one dosage unit having either only one biologically-active substance or multiple storage-compatible substances. In some embodiments, each receptacle 62 is designed to hold a plurality of dosage units.

In some embodiments, each predetermined area including one or more receptacles 62 may have an independently removable or breakable seal. In some embodiments, each receptacle 62 is moisture resistant and independently sealed. In some embodiments, one or more receptacles 62 may comprise a blister pack including a push-through pack, which has a lid material of aluminum foil or aluminum foil laminate. In some embodiments, a base of one or more receptacles 62 may be plastic, such as, for example, PVC, polyamides, polyolefins, polyesters and laminates or multi-layered materials. In some embodiments, the lid foil of a receptacle 62 may be provided with a line of weakness in a region of each receptacle 62 such that the line of weakness may be a tab for gripping that enables a receptacle 62 to be exposed by manipulation of the lid foil.

In some embodiments, receptacle 62 may be made embossed, cast deep drawn or vacuum formed out of plastic, plastic laminates, plastic/paper laminates or plastic/metal foil laminates. In some embodiments, receptacle 62 comprises a barrier layer against gases and vapors, which may be fabricated from a metal foil such as an aluminum foil embedded in a plastic laminate or ceramic layers or metallic layers embedded between two plastic layers.

In some embodiments, a dose of medicament, medication or drug can include, such as, for example, a chewable tablet, quick dissolve tablet, effervescent tablet, reconstitutable powder, elixir, liquid, solution, suspension, emulsion, tablet, multi-layer tablet, bi-layer tablet, capsule, soft gelatin capsule, hard gelatin capsule, caplet, lozenge, chewable lozenge, bead, powder, granules, dispersible granules, cachets, douche, suppository, cream, topical, inhalant, aerosol inhalant, patch, particle inhalant, implant, depot implant, dragee, ampoule, ingestible, injectable, infusion, health bar, liquid, food, nutritive food, functional food, yogurt, gelatin, cereal, cereal coating, animal feed and/or combinations thereof.

In some embodiments, indicia 64 of a medication regimen, direction, instruction and/or prescription for administration of the medication regimen may include dosage day indicia, a specific day of the week, such as Monday, Tuesday, Wednesday, Thursday, Friday, Saturday, Sunday or an abbreviation of said day, a specific date or a general succession of days, such as day 1, day 2, day 3. In some embodiments, indicia 64 may include time indicia that may be, such as, for example, a general time of the day corresponding to each of receptacles 62 or a specific time of the day corresponding to each of receptacles 62, such as, for example, AM, PM, morning, afternoon, evening, day, night, daytime, nighttime and combinations thereof. In some embodiments, indicia 64 may include each separate row or column of a unit dose page 60 indicating a time of day, such as AM doses and PM doses. In some embodiments, receptacle 62 and/or an adjacent area may be color coded for time indicia. In some embodiments, one or more components of medicament dispensing system 10 may include a key defining or explaining color coding.

In some embodiments, a dose unit may comprise vitamin A, B vitamins, vitamin C, vitamin D, vitamin E, vitamin K, essential fatty acids, folic acid, iron, calcium, magnesium, potassium, copper, chromium, zinc, molybdenum, iodine, boron, selenium, manganese, derivatives thereof and/or combinations thereof. In some embodiments, biologically-active substances may include thiamin, thiamin pyrophosphate, riboflavin, flavin mononucleotide, flavin adenine dinucleotide, niacin, nicotinic acid, nicotinamide, niacinamide, nicotinamide adenine dinucleotide, tryptophan, biotin, pantothenic acid, ascorbic acid, retinol, retinal, retinoic acid, beta-carotene, 1,25-dihydroxycholecalciferol, 7-dehyrdocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and/or combinations and derivatives thereof.

In some embodiments, a dose unit may be prescription and/or non-prescription substances. In some embodiments, the prescription substance may be a hormone replacement agent, a contraceptive agent, an osteoporotic agent, a chemotherapeutic agent, an anti-infective agent, analgesic, a steroid, an appetite suppressant, a weight loss agent, a tobacco antagonist, a cholesterol reducer and/or combinations thereof.

In some embodiments, the prescription substances may include, such as, for example, ticagrelor (anti-platelet), clopidogrel (anti-platelet), prasugrel (anti-platelet), carvedilol (beta blocker), metoprolol succinate (beta blocker), metoprolol tartrate (beta blocker), lisinopril (ACE inhibitor), losartan (angiotensin receptor blocker), valsartan (angiotensin receptor blocker), atorvastatin (statin), simvastatin (statin), spironolactone (aldosterone receptor blocker/diuretic), atenolol, erythromycin, penicillins, cephalosporins, theophylline, albuterol, terbutaline, diltiazem, propranolol, nifedepine, clonidine, thioridazine, diazepam, meclizine, ergoloid mesylates, chlorpromazine, carbidopa, levodopa, beclomethasone diproprionate, budesonide, dexamehasone, flunisolide, fluticasone proprionate, mometasone furoate, triamcinolone acetonide, beconase, pulmicort, rhinocort, decadron, aerobid/nasolide, flovent/flonase, azmacort, amprenavir, adefovir dipivoxil, zidovudine, azidothymidine, AZT, paclitaxel, cyclophosphamide, teniposide, taxol, cytoxan, vumon, methotrexate, methotrexate, cisplatin, carboplatin, oxaliplatin, platinol, paraplatin, adriamycin, bleomycin, dactinomycin, daunorubicin, doxorubicin, indarubicin, mitomycin, blenoxane, cosmegen, cerubidine, rubex, indamycin, mutamycin, BCNU, streptozocin, vinblastine, thiotepa, conjugated estrogens, esterified estrogens, estropipate, estradiol, ethinyl estradiol, medroxyprogesterone, meprobamate, desogestrel, levonorgestrel, norethindrone, norethindrone acetate, norgestimate, norgestrel, raloxifene, tamoxifen, methyltestosterone, quinapril, sotalol, alendronate, atorvastatin, colestipol, clofibrate, and/or combinations thereof.

In some embodiments, the non-prescription substance can be a vitamin or derivative thereof, and/or a mineral compound or derivative thereof. In some embodiments, the vitamin or mineral compound may be, such as, for example, thiamin, thiamin pyrophosphate, riboflavin, flavin mononucleoride, flavin adenine dinucleotide, niacin, nicotinic acid, nicotinamide, niacinamide, nicotinamide adenine dinucleotide, tryptophan, biotin, folic acid, pantothenic acid, ascorbic acid, retinol, retinal, retinoic acid, beta-carotene, 1,25-dihydroxycholecalciferol, 7-dehydrocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and combinations and derivatives thereof. In some embodiments, the derivatives of vitamin compounds include salts, alkaline salts, esters and chelates of any vitamin compound. In some embodiments, the nonprescription substance can be a herbal compound, herbal extract, derivative thereof and/or combinations thereof.

In some embodiments, a medication regimen can include a first dosage unit arrayed on a blister pack of receptacles 62 adjacent to a second dosage unit. In some embodiments, the medication regimen includes a first dosage unit disposed adjacent to a second dosage unit disposed with different receptacles 62.

Figure 6:
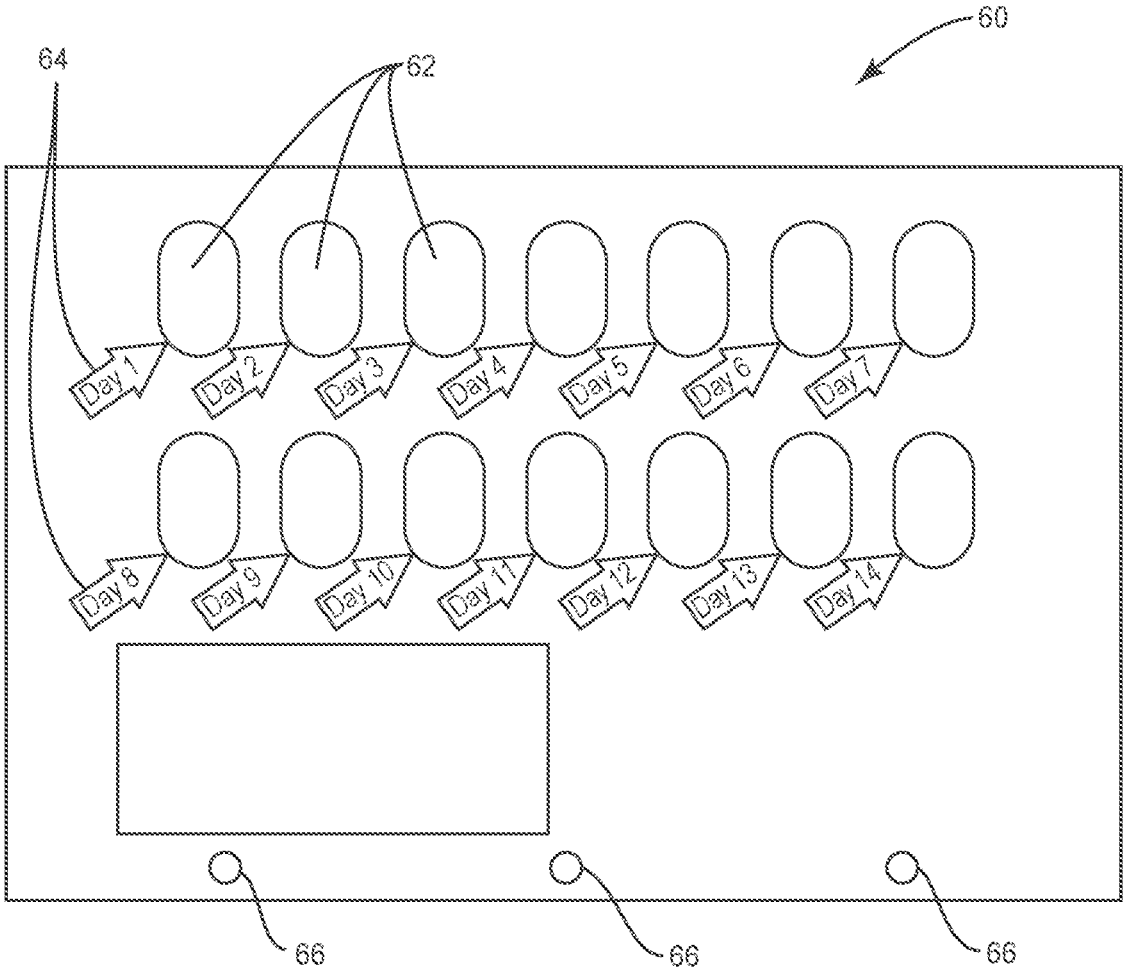
FIG. 6 is a plan view of a component of the system shown in FIG. 4.

In some embodiments, as shown in FIG. 6, unit dose page 60 comprises fourteen receptacles 62. One dosage unit is enclosed in each receptacle 62. Receptacles 62 are horizontally arranged in two rows adjacent to one another. In one embodiment, the rows are organized into weeks such that each row comprises seven receptacles 62. Unit dose page 60 comprises indicia 64 indicating the time and order in which the medications are to be taken by the patient. Each receptacle 62 is labeled with an arrow having the day the dosage should be taken according to a dosage regimen. Indicia 64 are screen printed on unit dose page 60. In some embodiments, indicia 64 may be hand written. Sections of unit dose page 60 are left blank to allow hand written notes or instructions by a patient, pharmacist or doctor. Unit dose page 60 comprises openings 66 to engage binder rings 34.

Figure 7:
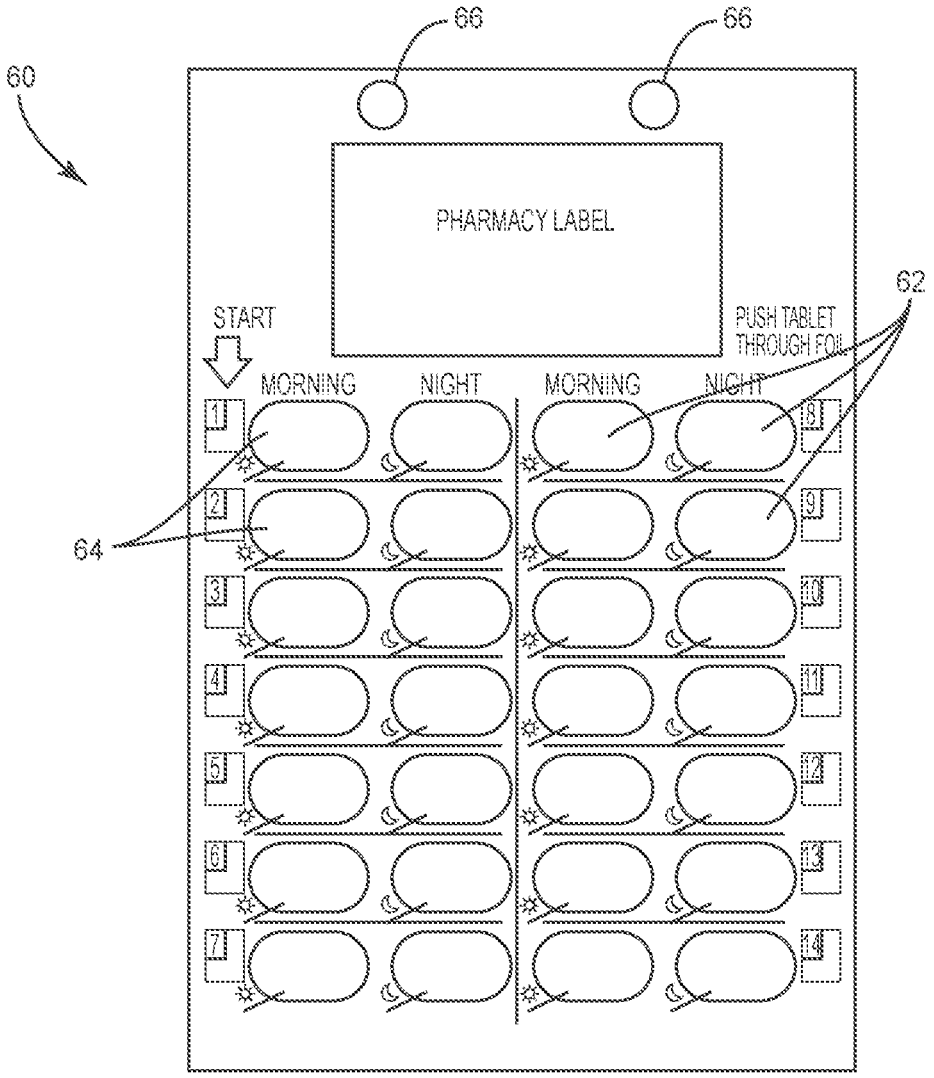
FIG. 7 is a plan view of a component of one embodiment of a system in accordance with the principles of the present disclosure.
Figure 8:
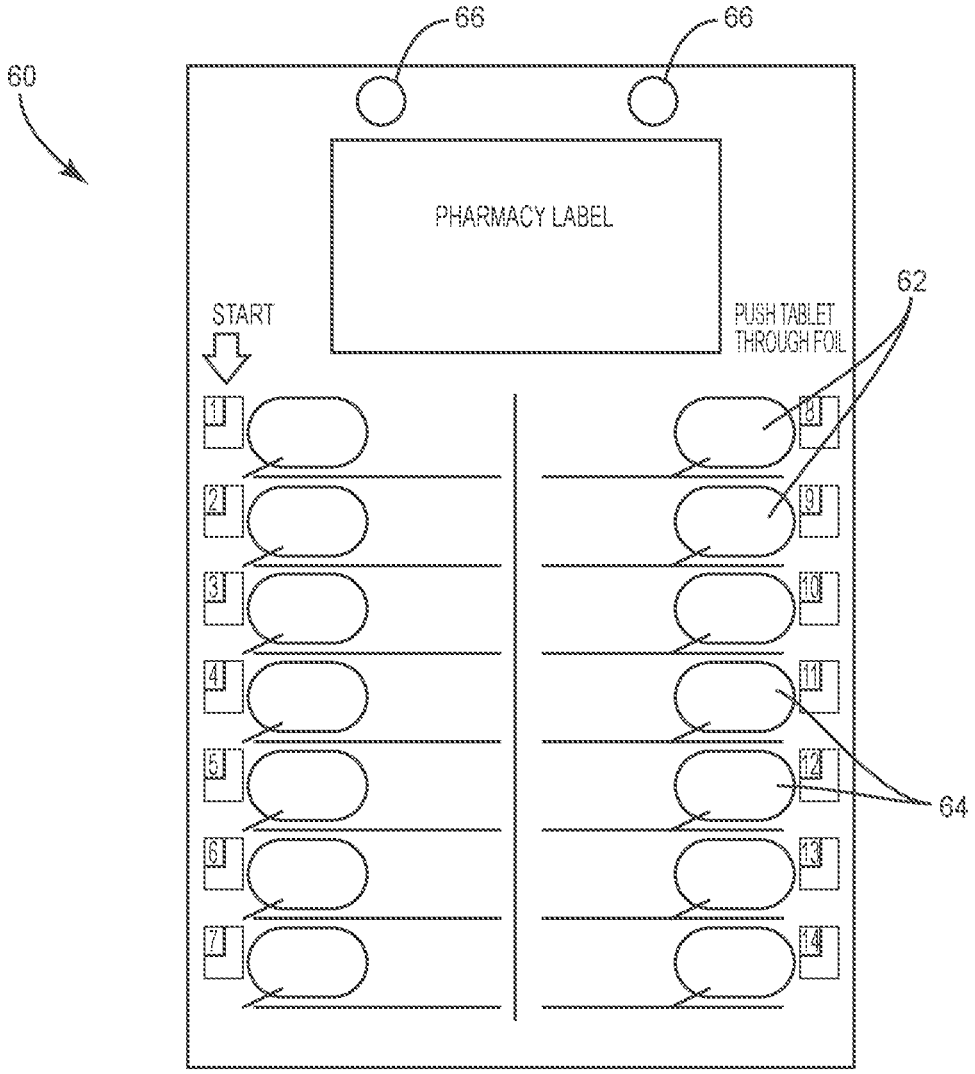
FIG. 8 is a plan view of a component of one embodiment of a system in accordance with the principles of the present disclosure.

In one embodiment, as shown in FIG. 7, unit dose page 60 comprises twenty-eight receptacles 62. One dosage unit is enclosed in each receptacle 62. Receptacles 62 are vertically arranged in two groupings of two rows adjacent to one another. The groupings are organized into weeks such that each grouping comprises fourteen receptacles 62. Unit dose page 60 comprises indicia 64 indicating the time and order in which the medications are to be taken by the patient. Each receptacle 62 is labeled with a number to indicate the day of a dosage regimen the medications should be taken. Indicia 64 includes graphics to indicate the time of day the medications should be taken. Indicia 64 are screen printed on page 60. In some embodiments, indicia 64 may be hand written. Sections of page 60 are left blank to allow hand written notes or instructions by a patient, pharmacist or doctor. Unit dose page 60 comprises openings 66 to engage binder rings 34.

In some embodiments, unit dose page 60 comprises indicia 64 to indicate the name and/or nature of the medications being administered. In some embodiments, indicia 64 include a list of possible side effects of the medications being administered. In some embodiments, indicia 64 provide instructions on how long a patient should take the medication being administered.

Figure 5:
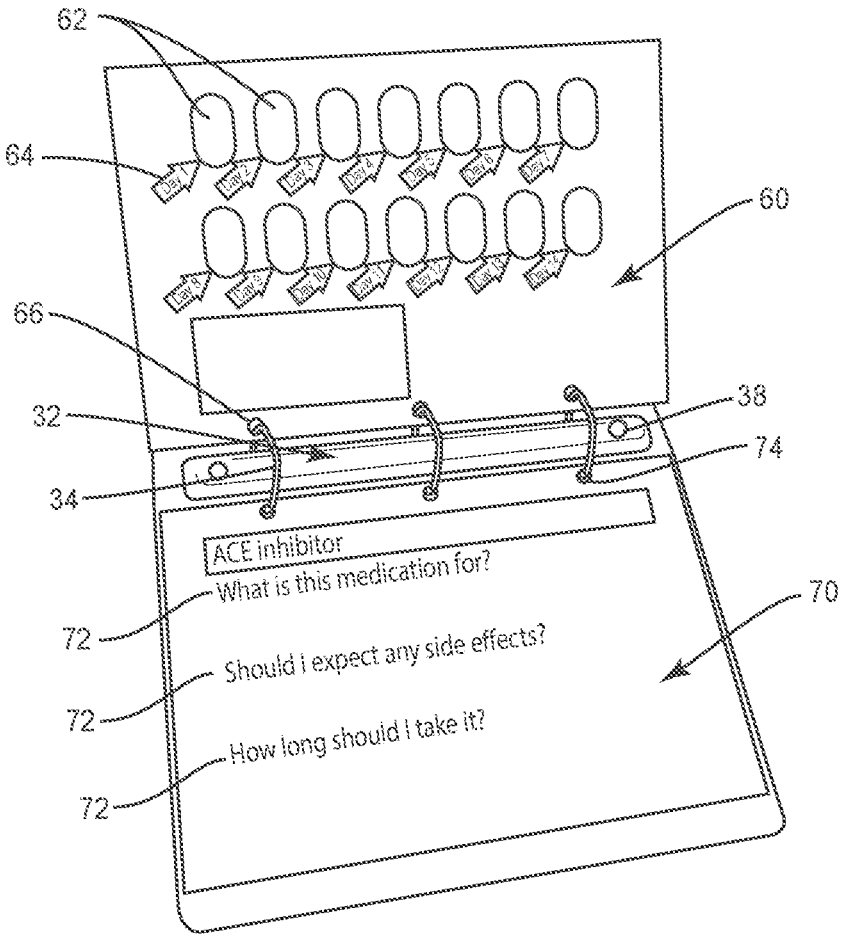
FIG. 5 is a perspective view of components of the system shown in FIG. 4.

In some embodiments, as shown in FIGS. 4 and 5, medicament dispensing system 10 comprises one or more information inserts 70 to educate a patient about a medication being administered in the dosage regimen. In some embodiments, information insert 70 comprises indicia 72 to indicate the name and/or nature of the medicine being administered. In some embodiments, indicia 72 include a list of possible side effects of the medications being administered. In some embodiments, indicia 72 provide instructions on how long a patient should take the medication being administered. Information insert 70 comprises openings to engage binder rings 34. In some embodiments, medicament dispensing system 10 includes a notepad 76 configured to fit into the cavity created when container 12 is in the closed configuration to facilitate a doctor, pharmacist, health care personnel and/or patient creating personalized reminders and notes for a patient.

In some embodiments, information insert 70 is printed onto a separate page to be viewed in tandem with unit dose page 60. In some embodiments, information insert 70 is printed onto the back of a first unit dose page 60 such that when a first unit dose page 60 is flipped, the information on information insert 70 corresponds with a second unit dose page 60 positioned behind the first unit dose page 60. In another embodiment, information insert 70 is printed onto a sticker label and is adhered to the back of first unit dose page 60 such that when a first unit dose page 60 is flipped, the information on information insert 70 corresponds with a second unit dose page 60 positioned behind the first unit dose page 60.

In one embodiment, medicament dispensing system 10, similar to the systems and methods described herein, including medicament dispensing container 12, as described herein, is employed in connection with treatment of a disease, illness and/or ailment of a patient. The components of medicament dispensing system 10 facilitate user/patient compliance with a medication regimen, as described herein, upon discharge from a health care facility, such as, for example, a hospital. In one embodiment, a patient utilizes medicament dispensing system 10 after being discharged from a hospital following a myocardial infarction and may be prescribed and/or directed to administer one or a plurality of prescription and/or non-prescription medications. For example, a patient may be prescribed an antiplatelet agent, aspirin, warfarin (anti-coagulant), a beta-blocker, an ACE inhibitor, a statin, nitro-glycerin, a docusate, and/or antidepressants in connection with treatment for the myocardial infarction.

In some embodiments, a medical practitioner and/or pharmacist reviews and/or considers medications including one or more prescriptions in connection with treatment for the myocardial infarction, one or more non-prescribed medications directed for administration by the patient in connection with treatment for the myocardial infarction, one or more existing prescriptions and/or one or more non-prescription medications and supplements being taken by the patient. The medical practitioner and/or pharmacist determines a medication regimen based on these medications using medicament dispensing system 10 to facilitate user/patient compliance with the medication regimen.

In some embodiments, based on the determined mediation regimen, health care personnel, such as, for example, pharmacy personnel prepare selected unit dose pages 60, information inserts 70 and/or notepads 76, as described herein, for disposal with a selected medicament dispensing container 12 specifically created for the myocardial infarction and the user/patient upon discharge from the hospital.

Medicament dispensing container 12 is portable such that the user/patient transports and/or carries medicament dispensing container 12 upon discharge. Slide 50 is translated from a child-tamper resistant position, as shown in FIG. 1, to a non-locked position, as shown in FIG. 2. Release buttons 46 are simultaneously engaged to release tabs 42 from engagement with wall 18, as shown in FIG. 3, to release cover 24 from pocket 14. The contents of pocket 14, which may include unit dose pages 60, information inserts 70 and/or notepads 76, as described herein, are accessible to the user/patient, as shown in FIG. 4. The user/patient employs the components of medicament dispensing system 10, for example, following direction via indicia 64 for administering dosage units from receptacles 62 and/or following instruction from indicia 64, information inserts 70 and/or notepads 76, to facilitate user/patient compliance with the medication regimen in connection with treatment for the myocardial infarction. Slide 50 can be translated to a locked position such that medicament dispensing container 12 is disposable in a child-tamper resistant, locked configuration, as shown in FIG. 1, for storage and subsequent use.

Figure 9:
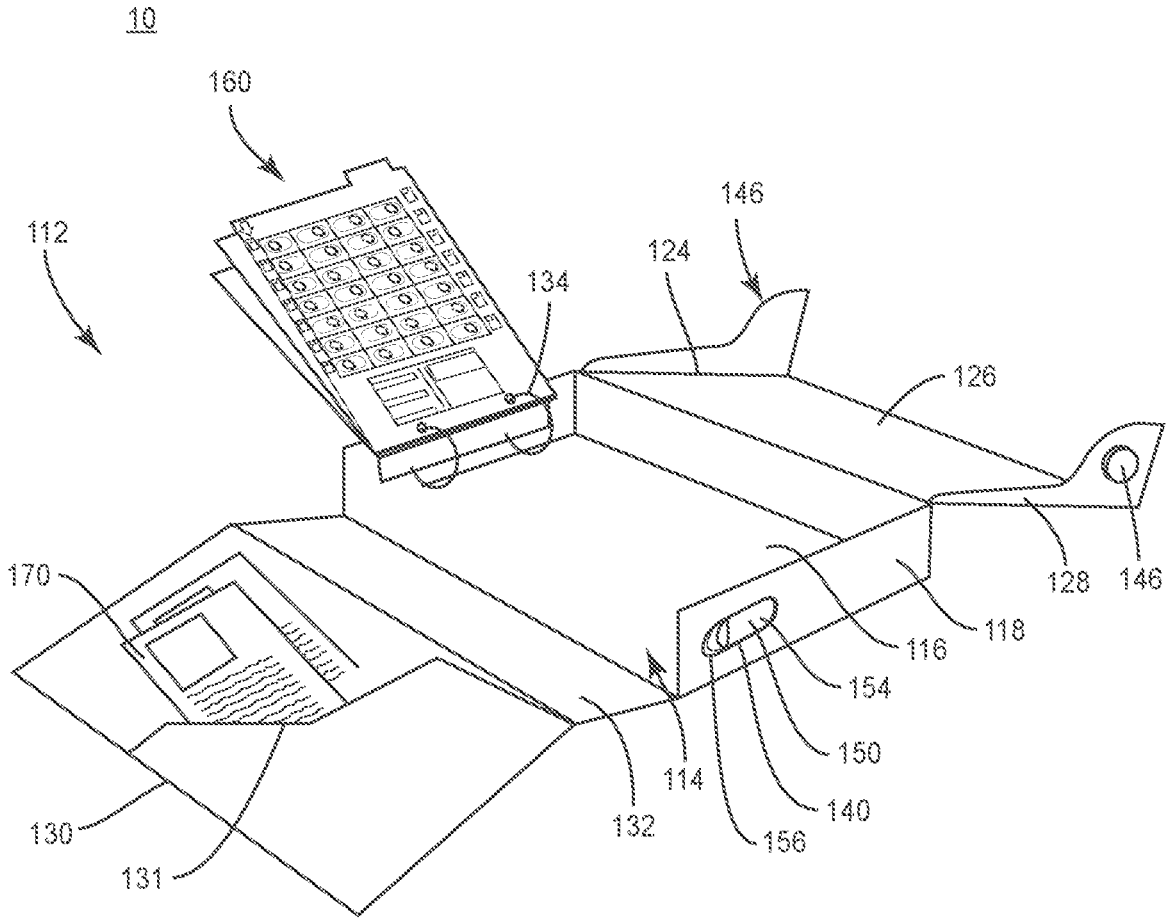
FIG. 9 is a perspective view of components of one embodiment of a system in accordance with the principles of the present disclosure.

In one embodiment, as shown in FIG. 9, medicament dispensing system 10, similar to the systems and methods of use of medicament dispensing system 10 described herein, includes a medicament dispensing device, such as, for example, a medicament dispensing container 112. Medicament dispensing container 112 includes a wall, such as, for example, a pocket 114 and a wall, such as, for example, a cover 124. Pocket 114 includes a bottom section 116 and a sidewall 118 extending around the perimeter of section 116. In one embodiment, bottom section 116 comprises a rectangular shape.

Cover 124 includes a top section 126, and a sidewall 128 extending around the perimeter of section 126. In one embodiment, section 126 comprises a rectangular shape. Pocket 114 is configured to fit inside cover 124. In some embodiments, sidewalls 118, 128 define a cavity when sidewall 128 is brought into contact with sidewall 118 as discussed herein. Container 112 includes a folder flap 130 positioned opposite cover 124. Flap 130 includes a sleeve 131 configured to receive an information insert 170, as disclosed herein. In some embodiments, flap 130 is attached to medicament dispensing container 112 at a connecting portion, such as, for example, a spine 132. Spine 132 is disposed with pocket 114 such that flap 130 is pivotable relative to pocket 114. Flap 130 is attached to spine 132 at an end opposite cover 124.

Cover 124 and flap 130 are each pivotable relative to pocket 114 between an open or non-locked configuration, such as, for example a medication accessible configuration, and a closed or locked configuration, such as, for example, a tamper resistant configuration, similar to that described herein. In some embodiments, medicament dispensing container 112 is disposable in a closed, locked and non-tamper resistant configuration such that a slide 150 is aligned with release buttons 146, as described herein.

In some embodiments, cover 124 is rotatable relative pocket 114 through an angular range of 0 through 360 degrees. In some embodiments, flap 130 is oppositely positioned from cover 124 and is rotatable relative to pocket 114 through an angular range of 0 through 360 degrees. In a closed configuration, spine 132, sidewalls 118, 128, and sections 116, 126 define a substantially enclosed cavity such that cover 124 and pocket 114 prevent access to contents of medicament dispensing container 112. In some embodiments, in a closed configuration, cover 124 and pocket 114 provide a child-resistant medicament dispensing container. In an open configuration, cover 124 and flap 130 are rotated relative to pocket 114 such that medicament dispensing container 112 rests on a surface to facilitate ease with the enclosed cavity is exposed to access to the contents of container 112.

In some embodiments, sidewall 118 comprises a coupling assembly, such as, for example, binder rings 134 disposed with an inner surface. Binder rings 134 are configured for engagement with unit dose pages 160 and/or information inserts 170, as discussed herein, similar to medicament dispensing system 10. In some embodiments, binder rings 134 comprise rings having separable halves to facilitate assembly of unit dose pages 160 and information inserts 170, and their subsequent removal. Binder rings 134 are connected with sidewall 118 with a pair of rivets positioned at opposite ends of binder rings 134. In some embodiments, binder rings 134 can be riveted to sidewall 118 by clips, screws, pins, nails, bolts, snaps or press studs.

Medicament dispensing container 112 includes a mechanism configured to connect pocket 114 with cover 124 for disposal of the components of medicament dispensing container 112 in a closed configuration. In one embodiment, sidewall 118 includes a surface defining one or more apertures 140. Sidewall 118 includes two oppositely positioned apertures 140 having a circular shape.

Cover 124 includes a mating element, such as, for example, a release button 146 configured to mate with apertures 140. Button 146 is positioned adjacent a distal end of sidewall 128 and extends transversely from an outer surface of sidewall 128. In one embodiment, release button 146 has a cylindrical shape to mate with aperture 140.

Sidewall 128 is configured for resilient engagement with an inner surface of sidewall 118. As medicament dispensing container 112 is moved between an open configuration and a closed configuration, engagement of sidewall 128 with sidewall 118 causes sidewall 128 to move, flex, pivot and/or rotate relative to section 126. In some embodiments, a resilient bias of sidewall 128 causes button 146 to snap into aperture 140.

When moving from a closed configuration to an open configuration, the user engages release buttons 146 to translate release buttons 146 through apertures 140 out of engagement with sidewall 118. Cover 124 is rotated about pocket 114 to an open configuration of medicament dispensing container 112. In some embodiments, release buttons 146 comprise a beveled surface (not shown) adjacent a distal end of sidewall 128 to facilitate closing medicament dispensing container 112 from an open configuration to a closed configuration. As cover 124 is rotated toward a closed configuration, the beveled surface engages sidewall 118 to cause sidewall 128 to move, flex, pivot and/or rotate. Cover 124 is rotated toward a closed position until release buttons 146 snap into apertures 140.

In some embodiments, sidewall 128 is provided with indicia, such as, for example, instructions to aid a user patient in use of medicament dispensing container 112. The instructions may be presented in the form of a graphic, such as, for example, a bulls eye, or text, such as, for example, "push here". In some embodiments, the instructions may be printed onto a surface of release buttons 146. In some embodiments, the instructions may be printed onto sidewall 118 adjacent slide 150, as described herein.

Medicament dispensing container 112 includes a locking mechanism, such as, for example, a slide 150. Slide 150 is disposed with sidewall 118. Slide 150 translates relative to sidewall 118 via a slot (not shown) positioned adjacent aperture 140. The slot defines limits for translation of slide 150 along sidewall 118. Slide 150 comprises a handle 154 having a surface configured to facilitate translation by the user. Slide 150 comprises at least one window 156. Slide 150 comprises two spaced apart windows 156 configured to translate for alignment and non-alignment with apertures 140 for disposal of medicament dispensing container 112 between a locked configuration and a non-locked configuration. In one embodiment, container 112 comprises two oppositely positioned slides 150 for alignment with two oppositely positioned apertures 140.

Slide 150 is translatable between a locking position and a non-locked position, similar to that described herein. In a locked position, slide 150 is disposed such that windows 156 and apertures 140 are disposed in non-alignment and apertures 140 are covered by slide 150. Release buttons 146 are not accessible by a user in a locked position. In a non-locked position, slide 150 is oriented such that windows 156 are aligned with apertures 140 to access release buttons 146. Release buttons 146 are accessible for engagement to release cover 124 from pocket 114 in a non-locked position.

In some embodiments, slide 150 audibly clicks to indicate a locked position. In some embodiments, slide 150 is provided with instructions to aid a patient in use of medicament dispensing container 112. In some embodiments, the instructions may be presented in the form of a graphic, such as, for example, an arrow with a lock, or text, such as, for example, "slide to unlock". In some embodiments, the instructions may be printed on slide 150. Alternatively, in some embodiments, the instructions may be printed onto sidewall 118 adjacent slide 150.

Medicament dispensing container 112 comprises one or more unit dose pages 160, similar to unit dose pages 60 described herein, which store and/or contain one or more medications, such as, for example, a dose of at least one medication. In some embodiments, medicament dispensing system 110 comprises one or more information inserts 170, similar to information inserts 70 described herein, to educate a patient about a medication being administered in the dosage regimen.

In use, similar to that described herein, medicament dispensing container 112 is portable such that the user/patient transports and/or carries medicament dispensing container 112 upon discharge. Slide 150 is translated from a child-tamper resistant position to a non-locked position. Release buttons 146 are simultaneously engaged to release tabs 142 from engagement with wall 118 to release cover 124 from pocket 114. The contents of pocket 114, which may include unit dose pages 160, information inserts 170, as described herein, are accessible to the user/patient. The user/patient employs the components of medicament dispensing system 10, for example, following direction via indicia on pages unit dose 160 for administering dosage units from receptacles and/or following instruction from indicia on information inserts 170 to facilitate user/patient compliance with the medication regimen in connection with a treatment, as described herein. Slide 150 can be translated to a locked position such that medicament dispensing container 112 is disposable in a child-tamper resistant, locked configuration for storage and subsequent use.

Figure 10:
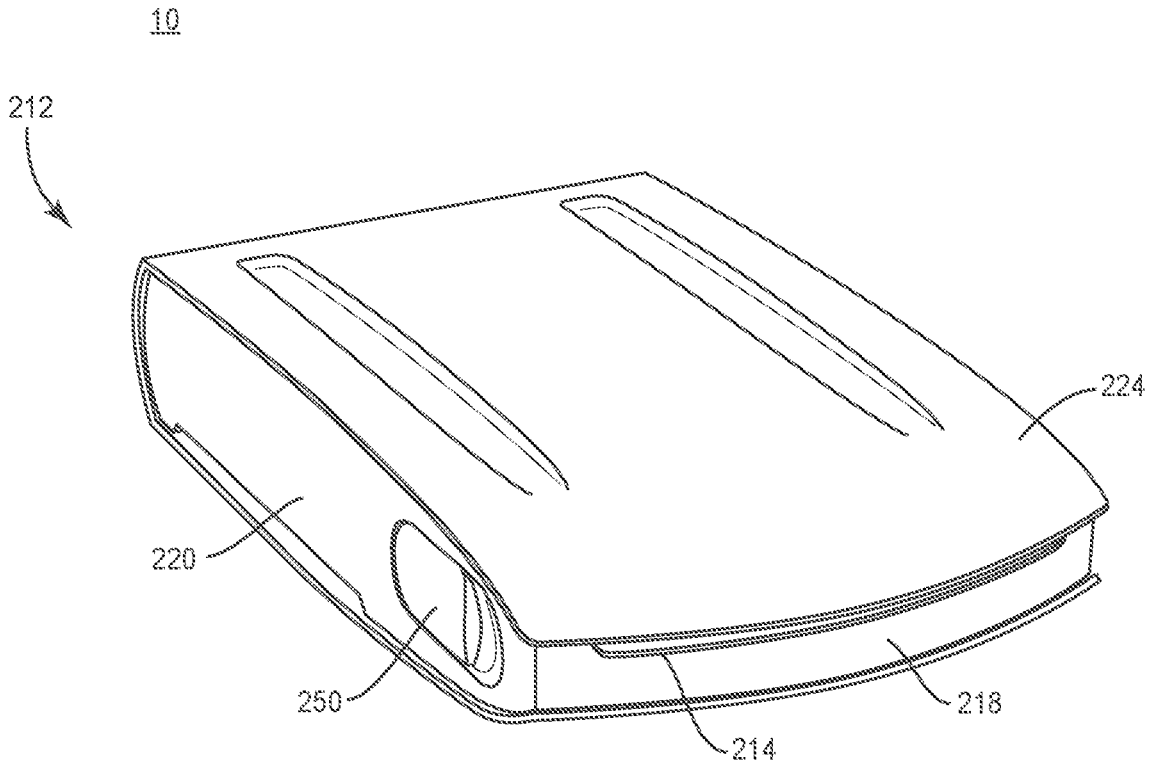
FIG. 10 is a perspective view of components of one embodiment of a system in accordance with the principles of the present disclosure.
Figure 11:
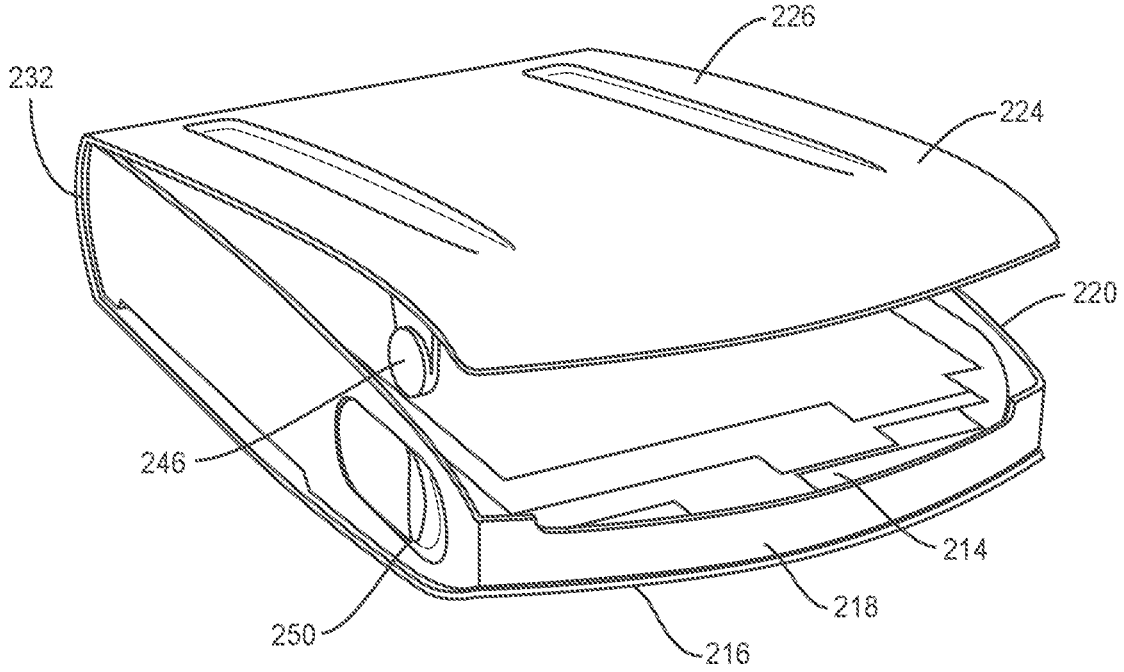
FIG. 11 is a perspective view of the components shown in FIG. 10.
Figure 12:
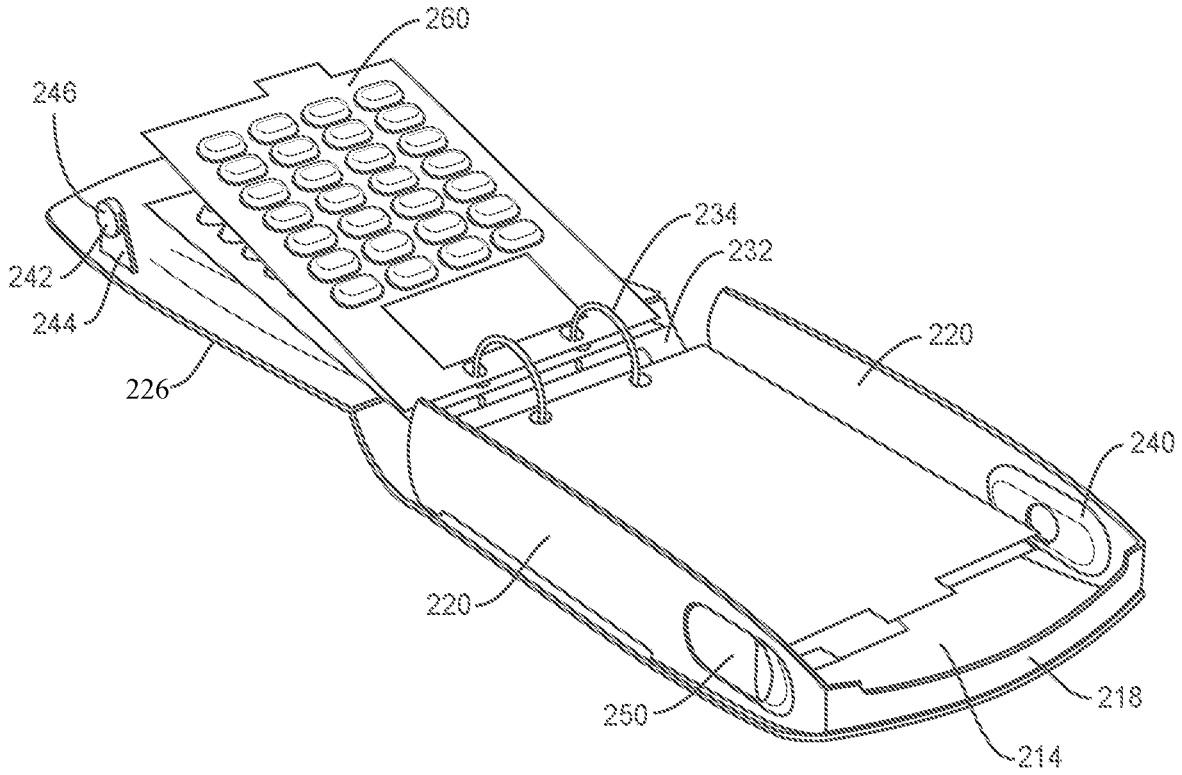
FIG. 12 is a perspective view of the components shown in FIG. 10.

In one embodiment, as shown in FIGS. 10-12, medicament dispensing system 10, similar to the systems and methods of use described herein, includes a medicament dispensing device, such as, for example, a medicament dispensing container 212. Medicament dispensing container 212 includes a wall, such as, for example, a pocket 214 and a wall, such as, for example, cover 224. Pocket 214 includes a bottom section 216, a front sidewall 218, and opposing sidewalls 220. In one embodiment, bottom section 216 comprises a rectangular shape. Sidewalls 220 are disposed on opposing sides of bottom section 216 such that sidewall 218 extends between sidewalls 220. Cover 224 includes a top section 226. In some embodiments, section 226 contacts sidewalls 218, 220 to define a cavity, as discussed herein.

In some embodiments, medicament dispensing container 212 includes a connecting portion, such as, for example, a spine 232. Spine 232 extends between pocket 214 and cover 224 such that cover 224 is pivotable relative to pocket 214. Cover 224 is attached to spine 232 at an end adjacent pocket 214, and pocket 214 is attached to spine 232 at an end opposite sidewall 218. Cover 224 is pivotable relative to pocket 214 between an open or non-locked configuration, such as, for example a medication accessible configuration and a closed or locked configuration, such as, for example, a tamper resistant configuration. In some embodiments medicament dispensing container 212 is disposable in a closed, locked and non-tamper resistant configuration such that a knob 250 is aligned with release buttons 246 to prevent buttons 246 from being engaged, as described herein.

In some embodiments, cover 224 is rotatable relative pocket 214 through an angular range of 0 through 360 degrees. In a closed configuration, spine 232, sidewalls 218, 220 and sections 216, 226 define a substantially enclosed cavity such that cover 224 and pocket 214 prevent access to contents of medicament dispensing container 212. In some embodiments, in a closed configuration, cover 224 and pocket 214 provide a child-resistant medicament dispensing container. In an open configuration, pocket 214 is rotated relative to cover 224 such that medicament dispensing container 212 rests flatly on a surface to facilitate ease of access to the contents of the cavity of medicament dispensing container 212.

In some embodiments, spine 232 comprises a coupling assembly, such as, for example, binder rings 234 configured for engagement with unit dose pages 260, similar to unit dose pages 60 and/or 160 described herein, and/or information inserts, similar to information inserts 70 and/or 170, as described herein. In one embodiment, binder rings 234 are configured to engage complementary openings of a unit dose page 260 and/or openings of an information insert, as discussed herein. In some embodiments, binder rings 234 comprise rings having separable halves to facilitate assembly of unit dose pages 260 and their subsequent removal. Binder rings 234 are connected with spine 232 with a pair of rivets positioned at opposite ends of binder rings 234. In some embodiments, binder rings 234 can be riveted to spine 232 by clips, screws, pins, nails, bolts, snaps or press studs. In one embodiment, when medicament dispensing container 212 is placed in a closed configuration, spine 232 conforms to the shape of binder rings 234.

Medicament dispensing container 212 includes a mechanism configured to connect pocket 214 with cover 224 for disposal of the components of medicament dispensing container 212 in a closed configuration. In one embodiment, sidewall 218 includes a surface defining one or more apertures 240. Sidewall 218 includes two oppositely positioned apertures 240 having a circular shape.

Cover 224 includes a mating element, such as, for example, a tab 242 configured to mate with sidewall 218 and/or apertures 240. Tab 242 extends along sidewall 228 such that tab 242 is aligned with sidewall 228. In some embodiments, tab 242 is attached to sidewall 228 via a connection point 244 adjacent top portion 226. In some embodiments, tab 242 flexibly extends from connection point 244, such that tab 242 is resiliently biased to a selected configuration, as described herein.

Tab 242 defines a locking surface, such as, for example, a release button 246. Release button 246 is positioned adjacent a distal end of tab 242 and extends transversely from tab 242. In one embodiment, release button 246 has a cylindrical shape to mate with aperture 240.

Tab 242 is configured for resilient engagement with an inner surface of sidewall 218. As medicament dispensing container 212 is moved between an open configuration and a closed configuration, engagement of tab 242 with sidewall 218 causes tab 242 to move, flex, pivot and/or rotate about connection point 244 between a position such that tab 242 is aligned with sidewall 228 and a position such that tab 242 moves, flexes, pivots and/or rotates into aperture 240. In some embodiments, the resilient bias of tab 242 causes button 246 to snap into aperture 240.

When moving from a closed configuration to an open configuration, the user engages release buttons 246 by inserting a finger or the like adjacent and/or behind knobs 250 to flex knobs 250 out of alignment with buttons 246 such that release buttons 246 translate through apertures 240 out of engagement with sidewall 218. Cover 224 is rotated about pocket 214 to an open configuration of medicament dispensing container 212. In some embodiments, release buttons 246 comprise a beveled surface (not shown) adjacent a distal end of tab 242 to facilitate closing medicament dispensing container 212 from an open configuration to a closed configuration. As cover 224 is rotated toward a closed configuration, the beveled surface engages sidewall 218 to cause tab 242 to move, flex, pivot and/or rotate about connection point 244. Cover 224 is rotated toward a closed position until release buttons 246 snap into apertures 240.

In some embodiments, tab 242 is provided with indicia, such as, for example, instructions to aid a user patient in use of medicament dispensing container 212. The instructions may be presented in the form of a graphic, such as, for example, a bulls eye, or text, such as, for example, "push here". In some embodiments, the instructions may be printed onto a surface of knob 250. In some embodiments, the instructions may be printed onto sidewall 218 adjacent a knob 250, as described herein.

Knob 250 is depressible to move container 212 between a locked position, as shown in FIG. 10, and a non-locked position, as shown in FIGS. 11 and 12. In a locked position, buttons 246 are disposed in apertures 240. Knob 250 is pressed to release buttons 246 from apertures 240. Release buttons 246 are accessible for engagement to release cover 224 from pocket 214 in a non-locked position.

Medicament dispensing container 12 comprises one or more unit dose pages 260, similar to unit dose pages 60 and/or 160 described herein, as shown in FIG. 12, that store and/or contain one or more medications, such as, for example, a dose of at least one medication. In some embodiments, medicament dispensing system 210 comprises one or more information inserts, similar to information inserts 70 and/or 170 described herein, to educate a patient about a medication being administered in the dosage regimen. In one embodiment, the insert comprises openings to engage binder rings 234.

In use, similar to that described herein, medicament dispensing container 212 is portable such that the user/patient transports and/or carries medicament dispensing container 212 upon discharge. Knob 250 is pressed to move container 212 from a child-tamper resistant position to a non-locked position. Release buttons 246 are simultaneously engaged to release tabs 242 from engagement with sidewalls 220 to release cover 224 from pocket 214. The contents of pocket 214, which may include unit dose pages 260 and information inserts, as described herein, are accessible to the user/patient. The user/patient employs the components of medicament dispensing system 210, for example, following direction via indicia on unit dose pages 260 for administering dosage units from receptacles and/or following instruction from indicia on the inserts to facilitate user/patient compliance with the medication regimen in connection with a treatment, as described herein. Tabs 242 are brought back into contact with sidewalls 220 to a locked position in which buttons 246 engage apertures 240 such that medicament dispensing container 212 is disposable in a child-tamper resistant, locked configuration for storage and subsequent use.

Figure 13:
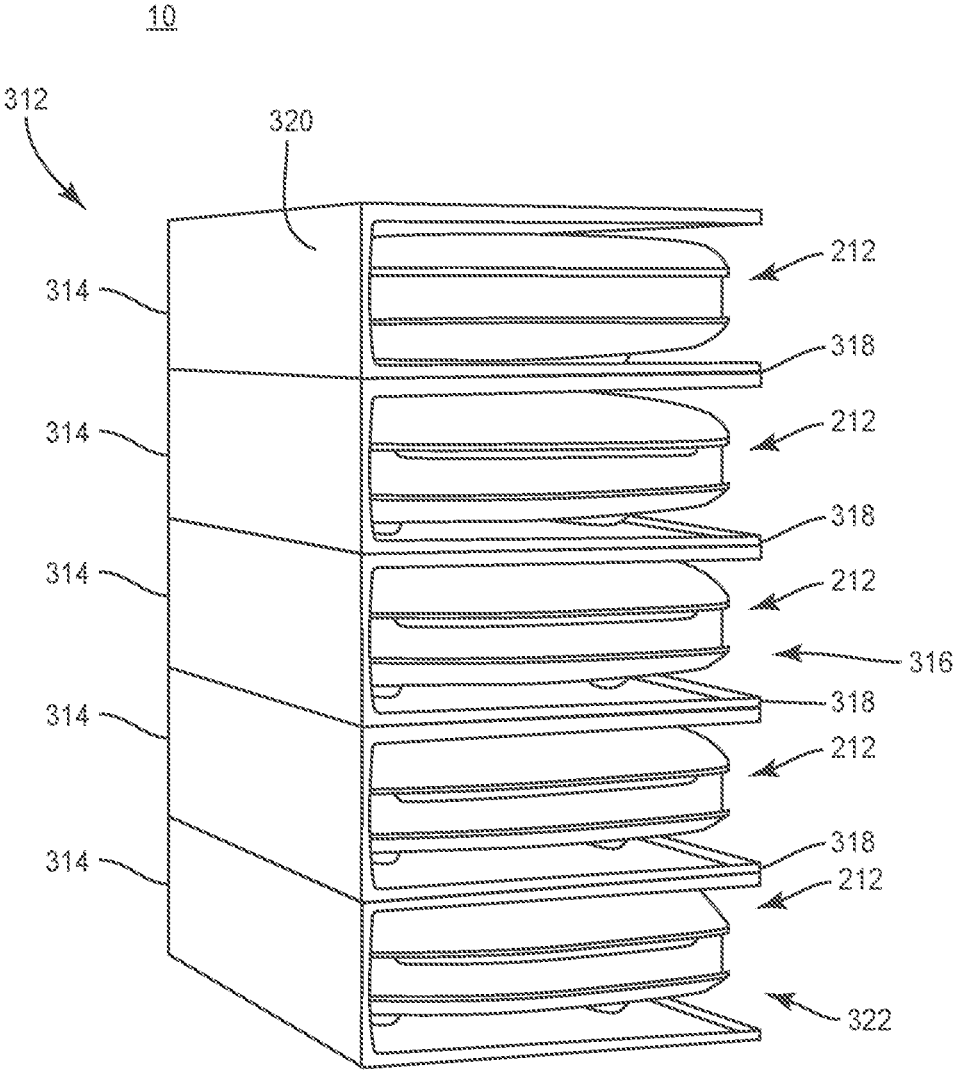
FIG. 13 is a perspective view of components of one embodiment of a system in accordance with the principles of the present disclosure.
Figure 14:
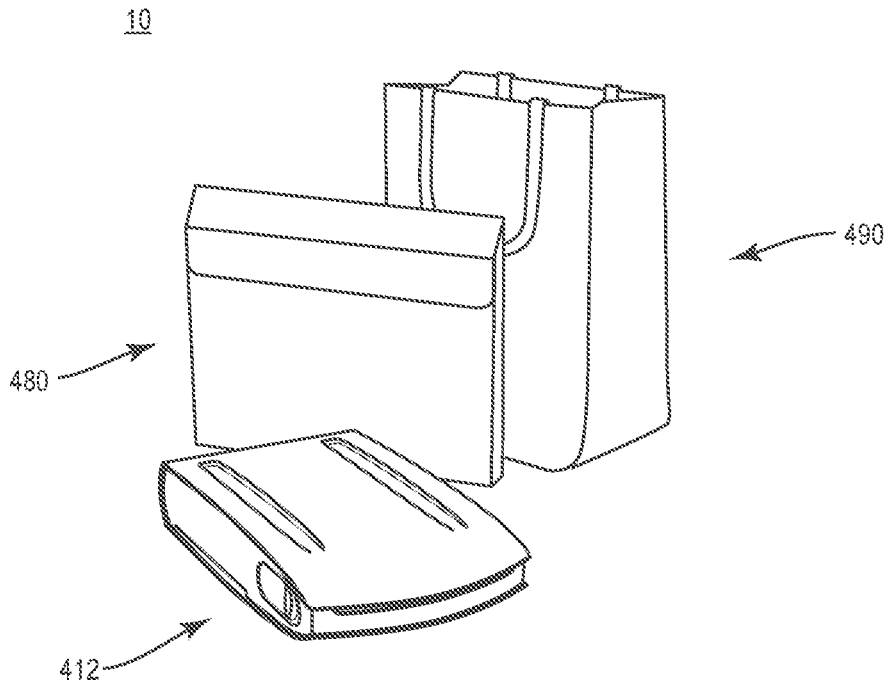
FIG. 14 is a perspective view of components of one embodiment of a system in accordance with the principles of the present disclosure.
Figure 15:
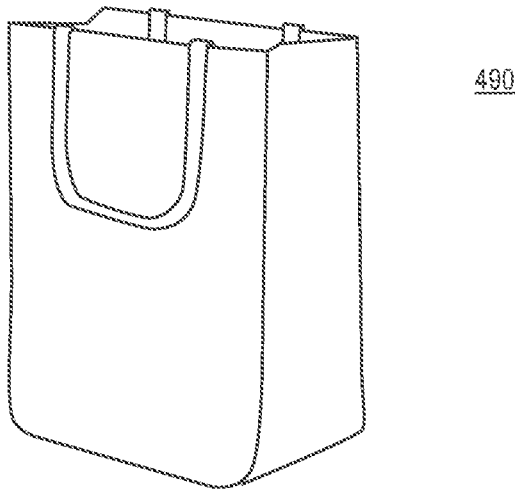
FIG. 15 is a perspective view of a component of the system shown in FIG. 14.
Figure 16:
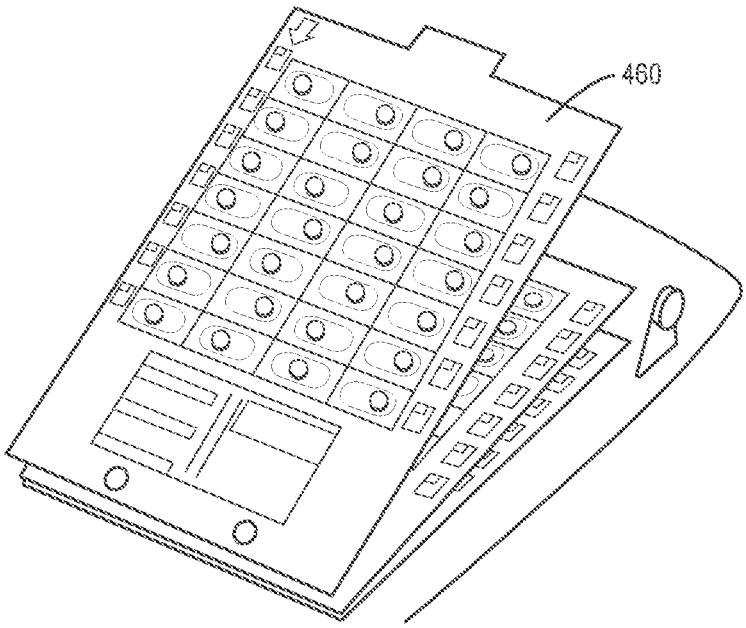
FIG. 16 is a perspective view of components of the system shown in FIG. 14.

In one embodiment, as shown in FIG. 13, medicament dispensing system 10, similar to the systems and methods of use described herein, includes a receptacle, such as, for example, a stack organizer 312. Stack organizer 312 includes a stackable configuration to facilitate efficient storage of medicament dispensing containers, such as, for example, medicament dispensing containers 212. In some embodiments, stack organizer 312 is configured for disposal of containers 212 in a linear and/or axial orientation. In some embodiments, stack organizer 312 is configured for disposal of medicament dispensing containers 212 in a staggered, offset, row or column orientation.

Stack organizer 312 is divided into sections 314. Sections 314 include compartments 316 separated by partitions 318. Each compartment 316 includes a wall 320 and openings 322. In some embodiments, stack organizer 312 is divided into five compartments 316. Each compartment 316 is equally sized and configured. In some embodiments, stack organizer 312 includes one or more compartments.

In one embodiment, as shown in FIGS. 14-21, medicament dispensing system 10, similar to the systems and methods of use described herein, includes a medicament dispensing device, such as, for example, a medicament dispensing container 412, similar to medicament dispensing container 212 described herein, a receptacle, such as, for example, an organizer 480 and a receptacle, such as, for example, a flexible tote bag 490 for disposal of components of system 10, such as, for example, medicament dispensing container 412, similar to medicament dispensing containers 12, 112 and 212, and organizer 480.

Figure 17:
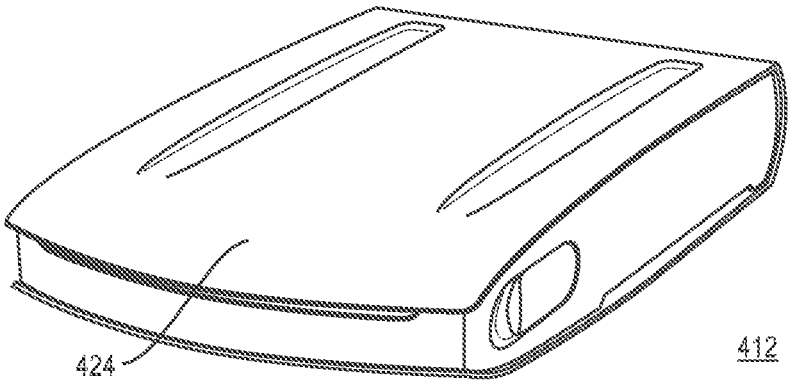
FIG. 17 is a perspective view of components of the system shown in FIG. 14.
Figure 18:
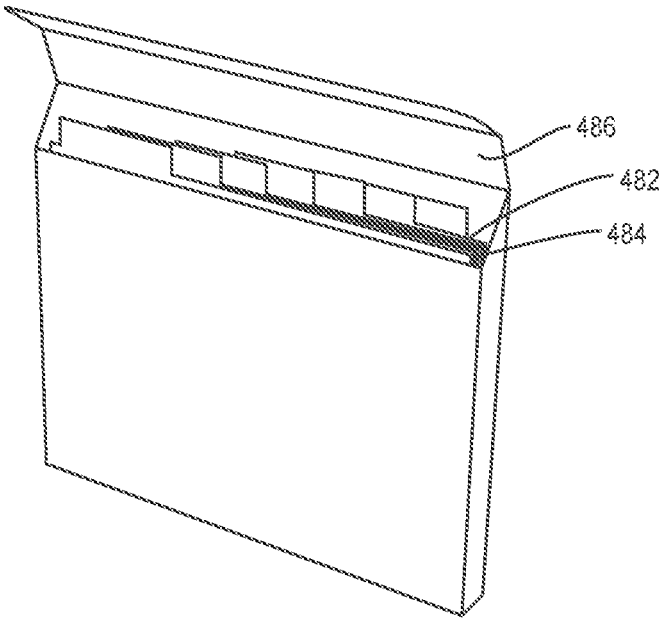
FIG. 18 is a perspective view of components of the system shown in FIG. 14.
Figure 19:
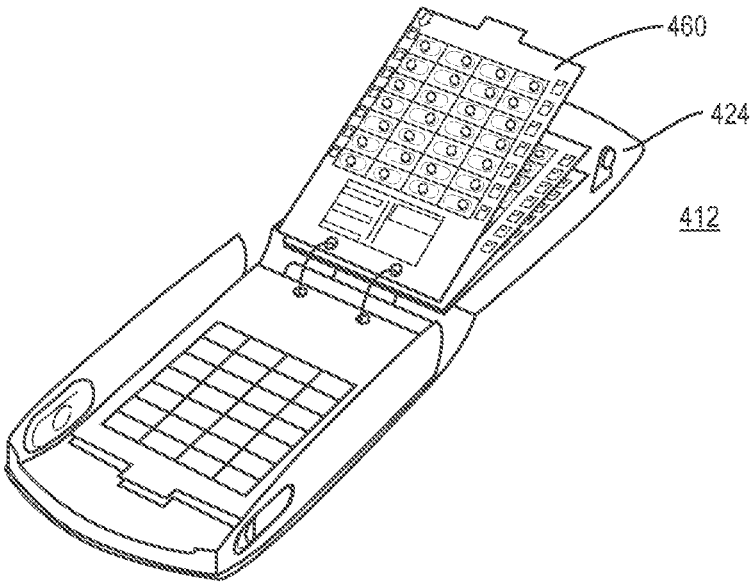
FIG. 19 is a perspective view of components of the system shown in FIG. 14.
Figure 20:
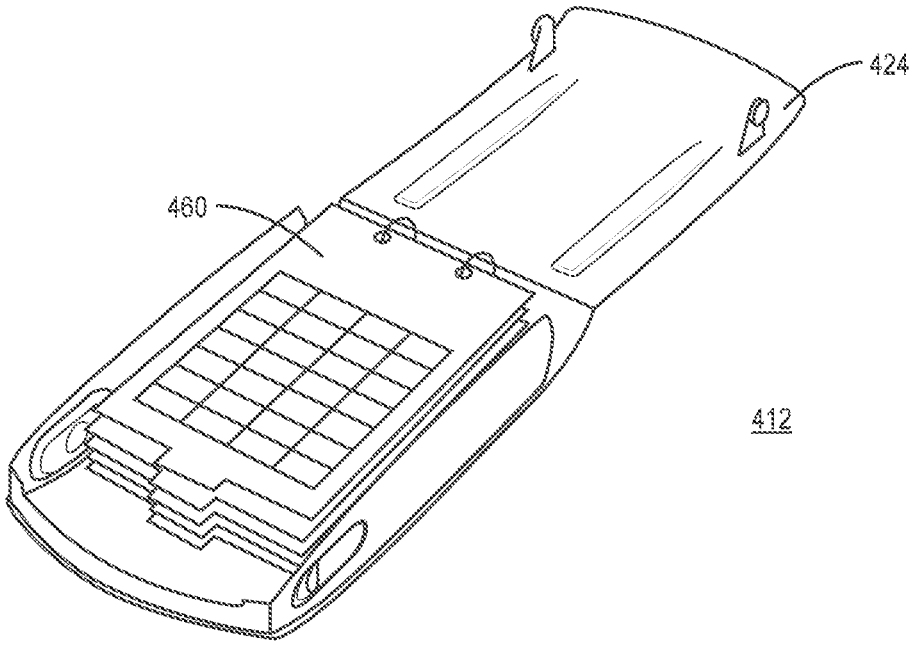
FIG. 20 is a perspective view of components of the system shown in FIG. 14.
Figure 21:
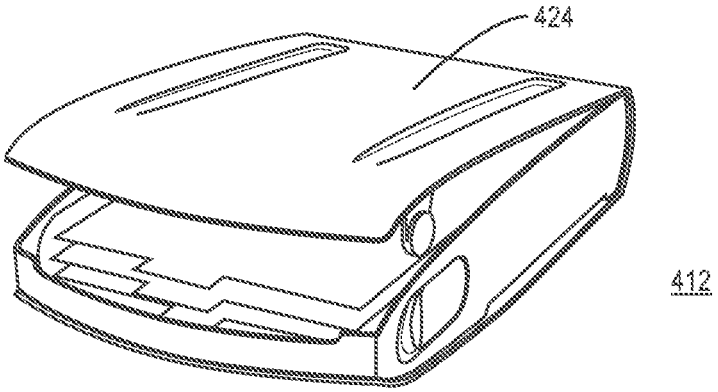
FIG. 21 is a perspective view of components of the system shown in FIG. 14.

Medicament dispensing container 412 includes a cover 424 that is pivotable between an open or non-locked configuration, such as, for example a medication accessible configuration, as shown in FIGS. 19-21, and a closed or locked configuration, such as, for example, a tamper resistant configuration, as shown in FIG. 17. Medicament dispensing container 412 comprises one or more unit dose pages 460, similar to unit dose pages 260 described herein that store and/or contain one or more medications, such as, for example, a dose of at least one medication.

Organizer 480 is divided into sections that include compartments 482 separated by partitions 484. In some embodiments, each compartment 482 is equally sized and configured. Organizer 480 includes a folder flap 486 attached to organizer 480. Flap 486 is pivotable relative to organizer 480.

In one embodiment, as shown in FIGS. 22-31, medicament dispensing system 10, similar to the systems and methods of use described herein, includes a medicament dispensing device, such as, for example, a medicament dispensing container 512.

Medicament dispensing container 512 includes a wall, such as, for example, a pocket 514 and a wall, such as, for example, a pocket 524. Pocket 514 includes a bottom section 516, a front sidewall 518, and opposing sidewalls 520. Walls 518, 520 define a surface 522. In one embodiment, bottom section 516 comprises a rectangular shape. Sidewalls 520 are disposed on opposing sides of bottom section 516 such that sidewall 518 extends between sidewalls 520.

Pocket 524 includes a top section 526, a front sidewall 528, and opposing sidewalls 530. Sidewalls 530 are disposed on opposing sides of top section 526 such that sidewall 528 extends between sidewalls 530. Walls 528, 530 define a surface 532. In one embodiment, top section 526 comprises a rectangular shape. Surface 522 is configured to mate with surface 532 to close medicament dispensing container 512. In one embodiment, pocket 524 includes an outer surface 542 that defines an outer pocket 544. Pocket 544 is configured for slidable disposal of, such as, for example, information inserts 570 and/or notepads 576 and/or other educational material.

Figure 22:
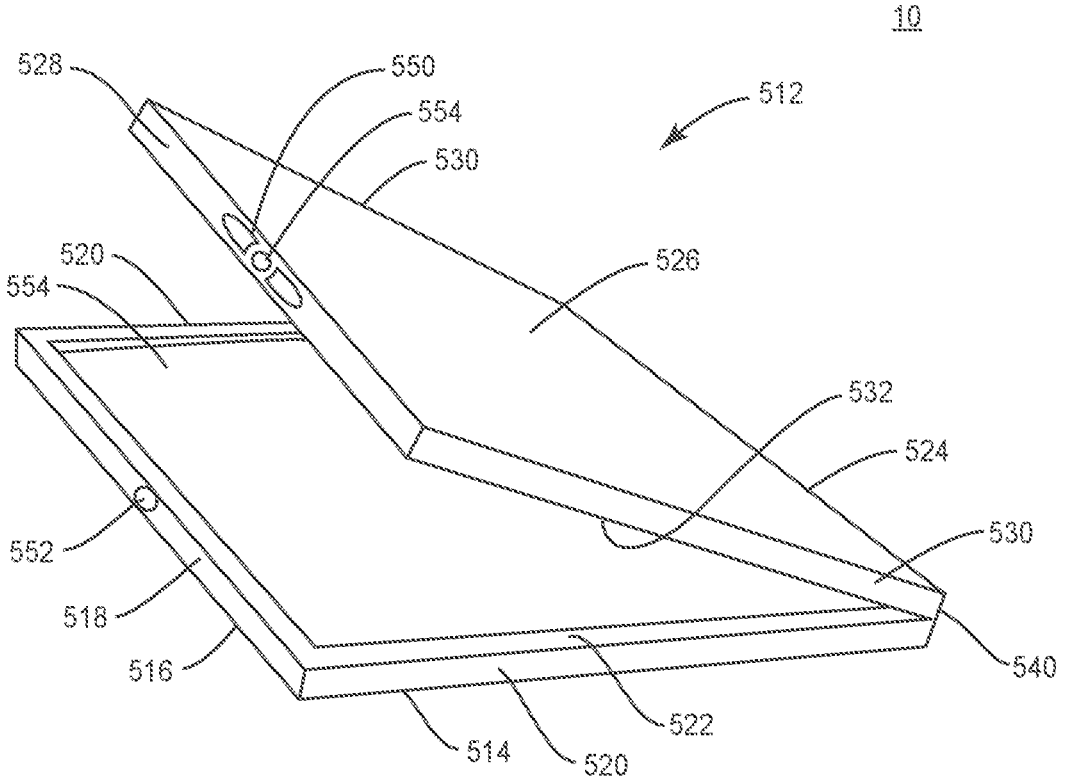
FIG. 22 is a perspective view of components of one embodiment of a system in accordance with the principles of the present disclosure.
Figure 23:
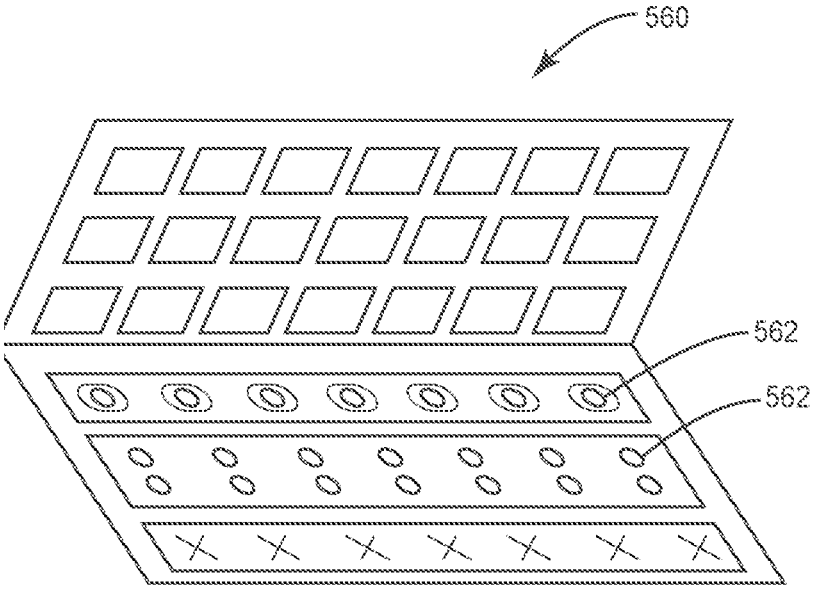
FIG. 23 is a perspective view of components of one embodiment of a system in accordance with the principles of the present disclosure.
Figure 27:
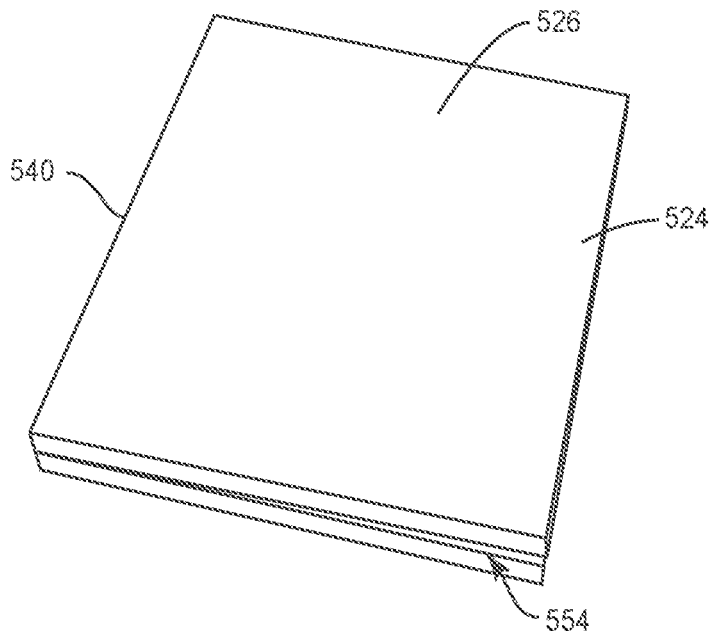
FIG. 27 is a perspective view of components of one embodiment of a system in accordance with the principles of the present disclosure.
Figure 28:
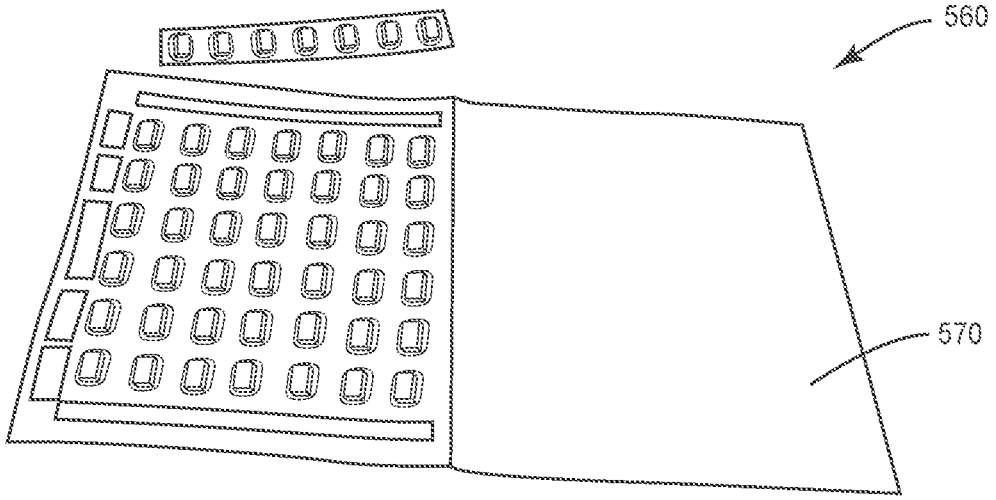
FIG. 28 is a perspective view of components of one embodiment of a system in accordance with the principles of the present disclosure.

In some embodiments, medicament dispensing container 512 includes a connecting portion, such as, for example, a spine 540. Spine 540 extends between pocket 514 and pocket 524 such that pocket 524 is pivotable relative to pocket 514. Pocket 524 is attached to spine 540 at an end opposite sidewall 528, and pocket 514 is attached to spine 540 at an end opposite sidewall 518. Pocket 524 is pivotable relative to pocket 514 between an open or non-locked configuration, such as, for example a medication accessible configuration, as shown in FIG. 22, and a closed or locked configuration, such as, for example, a tamper resistant configuration. In some embodiments, as shown in FIG. 27, medicament dispensing container 512 is disposable in a closed, locked and non-tamper resistant configuration with a locking mechanism 550.

Figure 29:
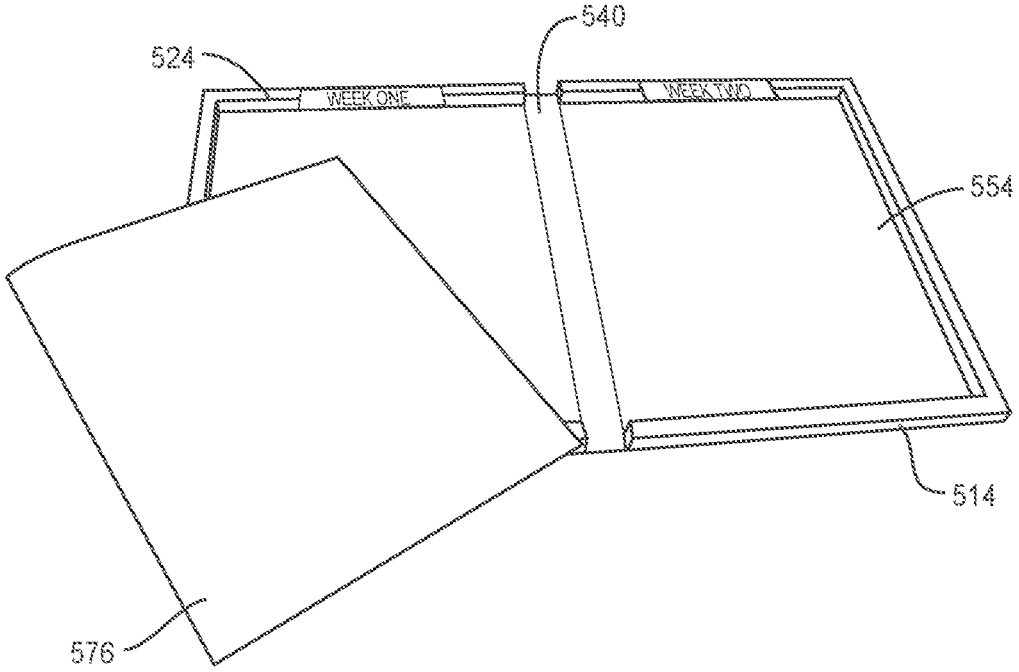
FIG. 29 is a perspective view of components of one embodiment of a system in accordance with the principles of the present disclosure.
Figure 30:
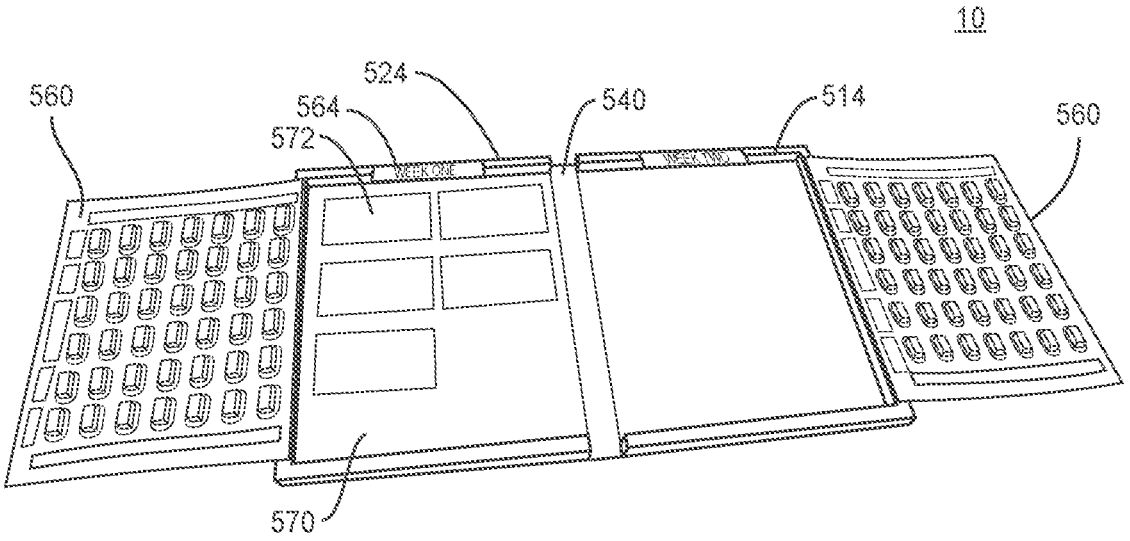
FIG. 30 is a perspective view of components of one embodiment of a system in accordance with the principles of the present disclosure.
Figure 31:
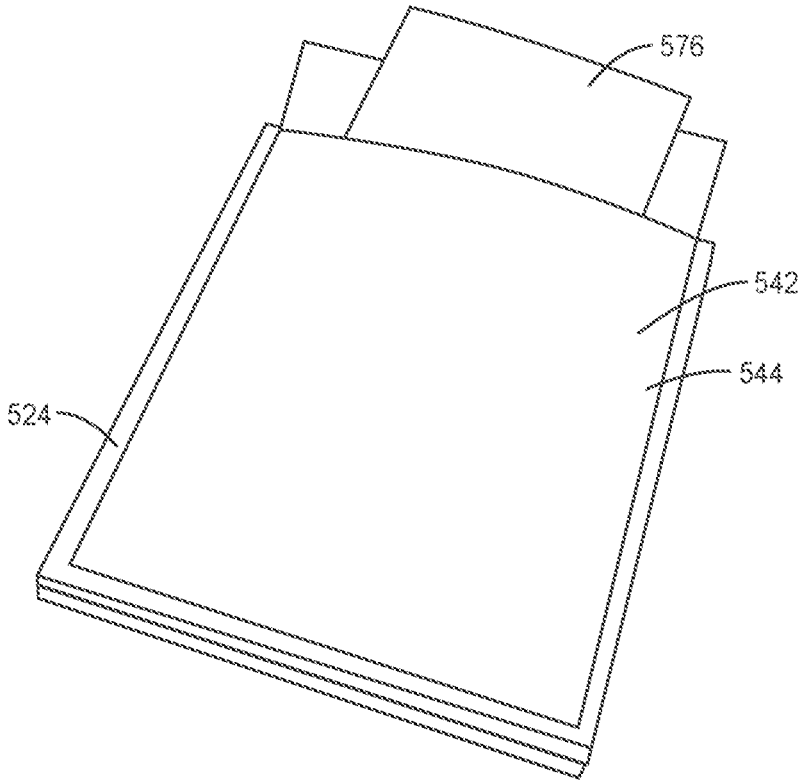
FIG. 31 is a perspective view of components of one embodiment of a system in accordance with the principles of the present disclosure.

In some embodiments, pocket 524 is rotatable relative to pocket 514 through an angular range of 0 through 360 degrees. In a closed configuration, as shown in FIG. 27, spine 540, sidewalls 518, 520, 528, 530, and sections 516, 526 define a substantially enclosed cavity 554 configured for disposal of unit dose pages 560 and/or information inserts 570, as discussed herein, such that pocket 524 and pocket 514 prevent access to contents of medicament dispensing container 512. In some embodiments, in a closed configuration, pocket 524 and pocket 514 provide a child-resistant medicament dispensing container. In an open configuration, as shown in FIGS. 29 and 30, pocket 514 is rotated relative to pocket 524 such that medicament dispensing container 512 rests flatly on a surface to facilitate ease of access to the contents of the cavity of container 512. In one embodiment, medicament dispensing container 512 is sized to facilitate carrying and storage of printer paper, such as, for example, 9 inches by 12 inches.

Medicament dispensing container 512 includes a mechanism configured to connect pocket 514 with pocket 524 for disposal of the components of medicament dispensing container 512 in a closed configuration. In some embodiments, pocket 514 and/or pocket 524 is provided with indicia, such as, for example, instructions to aid a user patient in use of medicament dispensing container 512. The instructions may be presented in the form of a graphic, such as, for example, a bulls eye, or text, such as, for example, "push here".

Medicament dispensing container 512 includes locking mechanism 550. Locking mechanism 550 includes a male engagement portion 552 and a female engagement portion 555. In some embodiments, locking mechanism 550 audibly clicks to indicate a locked position. In some embodiments, locking mechanism 550 is provided with instructions to aid a patient in use of medicament dispensing container 512. In some embodiments, the instructions may be presented in the form of a graphic, such as, for example, an arrow with a lock, or text, such as, for example, "slide to unlock". In some embodiments, the instructions may be printed on locking mechanism 550. Alternatively, in some embodiments, the instructions may be printed onto sidewall 518 adjacent locking mechanism 550.

Figure 24:
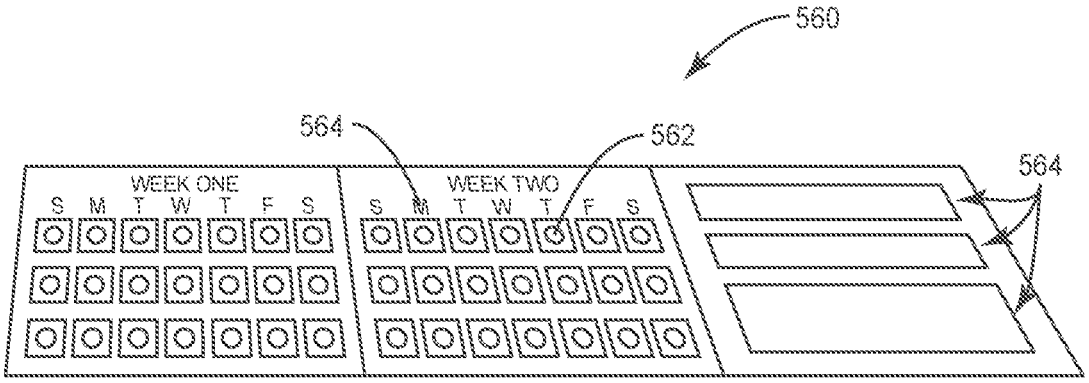
FIG. 24 is a perspective view of components of one embodiment of a system in accordance with the principles of the present disclosure.
Figure 25:
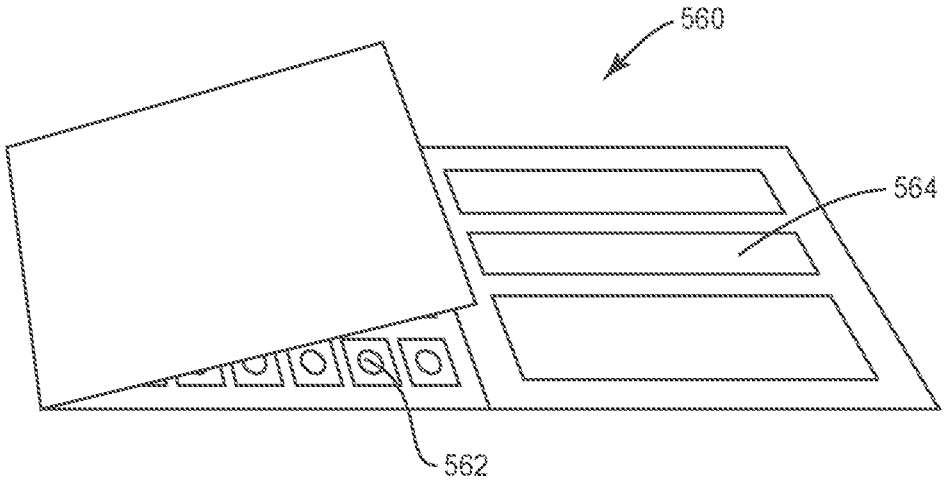
FIG. 25 is a perspective view of components of the system shown in FIG. 23.

Medicament dispensing container 512 comprises one or more unit dose pages 560, as shown in FIGS. 23-26, that store and/or contain one or more medications, such as, for example, a dose of at least one medication. The dose of medication(s) is enclosed and sealed in a plurality of receptacles 562. In some embodiments, medicament dispensing container 512 includes a plurality of unit dose pages 560. In one embodiment, the plurality of unit dose pages 560 is disposed in a trifold configuration, as shown in FIG. 24. In some embodiments, each unit dose page 560 encloses a different medication such that each medication that is part of a patient's dosage regimen is organized on separate unit dose pages 560. In some embodiments, unit dose page 560 comprises receptacles 562 indicating a patient's daily dosage of medication held within unit dose page 560. In some embodiments, unit dose page 560 comprises indicia 564, disposed with and displayed from a predetermined area adjacent one or more receptacles 562, indicating information regarding the medication enclosed within receptacles 562.

In some embodiments, medicament dispensing container 512 comprises a disposable dispensing device that provides therapeutic and/or nutritional support to an animal by increasing compliance with a dosing regimen, as described herein. In some embodiments, medicament dispensing container 512 and/or one or more unit dose pages 560 include blister packs, which comprise a plurality of receptacles 562. In some embodiments, each receptacle 562 accommodates a dosage unit and isolates that dosage unit from other dosage units. In some embodiments, a biologically-active substance within each dosage unit will not come into contact with the biologically-active substance of other dosage units.

Figure 26:
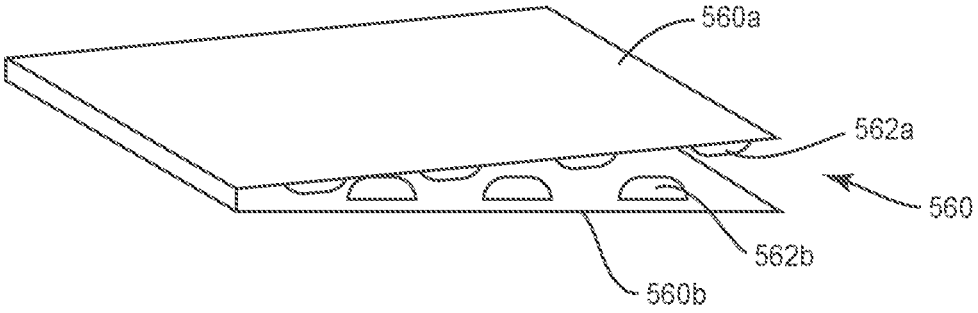
FIG. 26 is a perspective view of components of the system shown in FIG. 23.

In some embodiments, medicament dispensing container 512 and/or one or more unit dose pages 560 include a blister pack comprising at least one row of a plurality of receptacles 562 and/or areas including indicia 564. In some embodiments, each area defines at least one receptacle 562. In some embodiments, each receptacle 562 is designed to hold only one dosage unit having either only one biologically-active substance or multiple storage-compatible substances. In some embodiments, each receptacle 562 is designed to hold a plurality of dosage units. In one embodiment, as shown in FIG. 26, receptacles 562 are aligned such that receptacles **562*a* on one page 560*a* are configured for disposal between receptacles 562*b* within an opposing page 560*b* to facilitate closing of pages 560*a*, 560*b* with minimal for storage within medicament dispensing container 512**.

In some embodiments, each predetermined area including one or more receptacles 562 may have an independently removable or breakable seal. In some embodiments, each receptacle 562 is moisture resistant and independently sealed. In some embodiments, one or more receptacles 562 may comprise a blister pack including a push-through pack, which has a lid material of aluminum foil or aluminum foil laminate. In some embodiments, a base of one or more receptacles 562 may be plastic, such as, for example, PVC, polyamides, polyolefins, polyesters and laminates or multi-layered materials. In some embodiments, the lid foil of a receptacle 562 may be provided with a line of weakness in a region of each receptacle 562 such that the line of weakness may be a tab for gripping that enables a receptacle 562 to be exposed by manipulation of the lid foil.

In some embodiments, receptacle 562 may be made embossed, cast deep drawn or vacuum formed out of plastic, plastic laminates, plastic/paper laminates or plastic/metal foil laminates. In some embodiments, receptacle 562 comprises a barrier layer against gases and vapors, which may be fabricated from a metal foil such as an aluminum foil embedded in a plastic laminate or ceramic layers or metallic layers embedded between two plastic layers.

In some embodiments, a medication regimen can include a first dosage unit arrayed on a blister pack of receptacles 562 adjacent to a second dosage unit. In some embodiments, the medication regimen includes a first dosage unit disposed adjacent to a second dosage unit disposed with different receptacles 562.

In some embodiments, unit dose page 560 comprises fourteen receptacles 562. One dosage unit is enclosed in each receptacle 562. Receptacles 562 are horizontally arranged in two rows adjacent to one another. In one embodiment, the rows are organized into weeks such that each row comprises seven receptacles 562. Unit dose page 560 comprises indicia 564 indicating the time and order in which the medications are to be taken by the patient. Each receptacle 562 is labeled with an arrow having the day the dosage should be taken according to a dosage regimen. Indicia 564 are screen printed on unit dose page 560. In some embodiments, indicia 564 may be hand written. Sections of unit dose page 560 are left blank to allow hand written notes or instructions by a patient, pharmacist or doctor.

In one embodiment, unit dose page 560 comprises twenty-eight receptacles 562. One dosage unit is enclosed in each receptacle 562. Receptacles 562 are vertically arranged in two groupings of two rows adjacent to one another. The groupings are organized into weeks such that each grouping comprises fourteen receptacles 562. Unit dose page 560 comprises indicia 564 indicating the time and order in which the medications are to be taken by the patient. Each receptacle 562 is labeled with a number to indicate the day of a dosage regimen the medications should be taken. Indicia 564 includes graphics to indicate the time of day the medications should be taken. Indicia 564 are screen printed on unit dose page 560. In some embodiments, indicia 564 may be hand written. Sections of unit dose page 560 are left blank to allow hand written notes or instructions by a patient, pharmacist or doctor.

In one embodiment, unit dose page 560 comprises fourteen receptacles 562. One dosage unit is enclosed in each receptacle 562. Receptacles 562 are vertically arranged in two rows oppositely arranged from one another. The rows are organized into weeks such that each row comprises seven receptacles 562. Unit dose page 560 comprises indicia 564 indicating the time and order in which the medications are to be taken by the patient. Each receptacle 562 is labeled with a number to indicate the day a dosage regimen the medications should be taken. Indicia 564 are screen printed on unit dose page 560. In some embodiments, indicia 564 may be hand written. Sections of unit dose page 560 are left blank to allow hand written notes or instructions by a patient, pharmacist or doctor.

In some embodiments, unit dose page 560 comprises indicia 564 to indicate the name and/or nature of the medications being administered. In some embodiments, indicia 564 include a list of possible side effects of the medications being administered. In some embodiments, indicia 564 provide instructions on how long a patient should take the medication being administered.

In some embodiments, medicament dispensing system 10 comprises one or more information inserts 570 to educate a patient about a medication being administered in the dosage regimen. In some embodiments, information insert 570 comprises indicia 572 to indicate the name and/or nature of the medicine being administered. In some embodiments, indicia 572 include a list of possible side effects of the medications being administered. In some embodiments, indicia 572 provide instructions on how long a patient should take the medication being administered. In some embodiments, medicament dispensing system 10 includes a notepad 576 configured to fit into the cavity created when container 512 is in the closed configuration to facilitate a doctor, pharmacist, health care personnel and/or patient creating personalized reminders and notes for a patient.

In some embodiments, insert 570 is printed onto a separate page to be viewed in tandem with page 560. In some embodiments, insert 570 is disposed with pocket 514 and a first page 560 is disposed in pocket 524 such that when a first page 560 is viewed, the information on insert 570 can be viewed simultaneously In one embodiment, as shown in FIGS. 32-38, medicament dispensing system 10, similar to the systems and methods described herein, includes a medicament dispensing container 612. Medicament dispensing container 612 includes a pocket 614 and a pocket 624. Pocket 614 includes a bottom section 616, a front sidewall 618, and opposing sidewalls 620. Walls 618, 620 define a surface 622. Sidewalls 620 are disposed on opposing sides of bottom section 616 such that sidewall 618 extends between sidewalls 620.

Pocket 624 includes a top section 626, a front sidewall 628, and opposing sidewalls 630. Sidewalls 630 are disposed on opposing sides of top section 626 such that sidewall 628 extends between sidewalls 630. Walls 628, 630 define a surface 632. Surface 622 is configured to mate with surface 632 to close medicament dispensing container 612.

Figure 32:
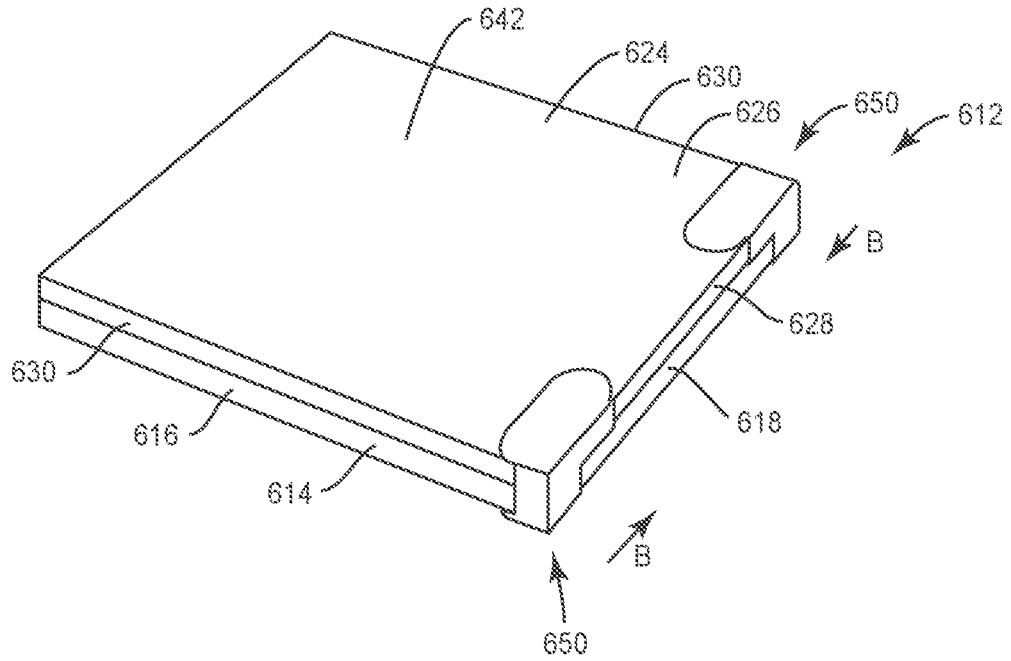
FIG. 32 is a perspective view of components of one embodiment of a system in accordance with the principles of the present disclosure.
Figure 33:
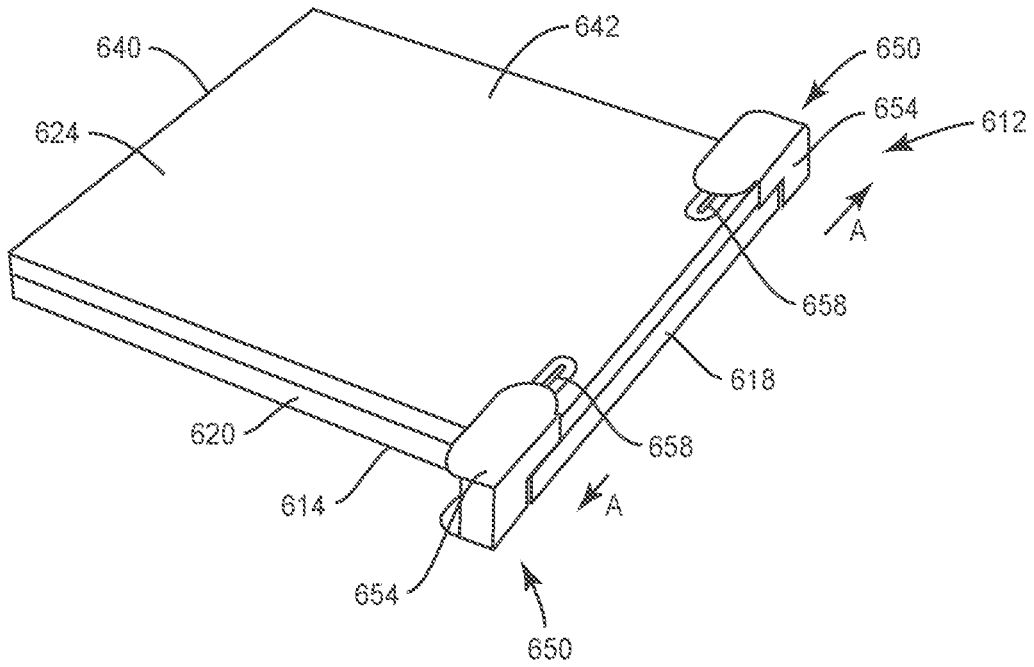
FIG. 33 is a perspective view of components of one embodiment of a system in accordance with the principles of the present disclosure.
Figure 34:
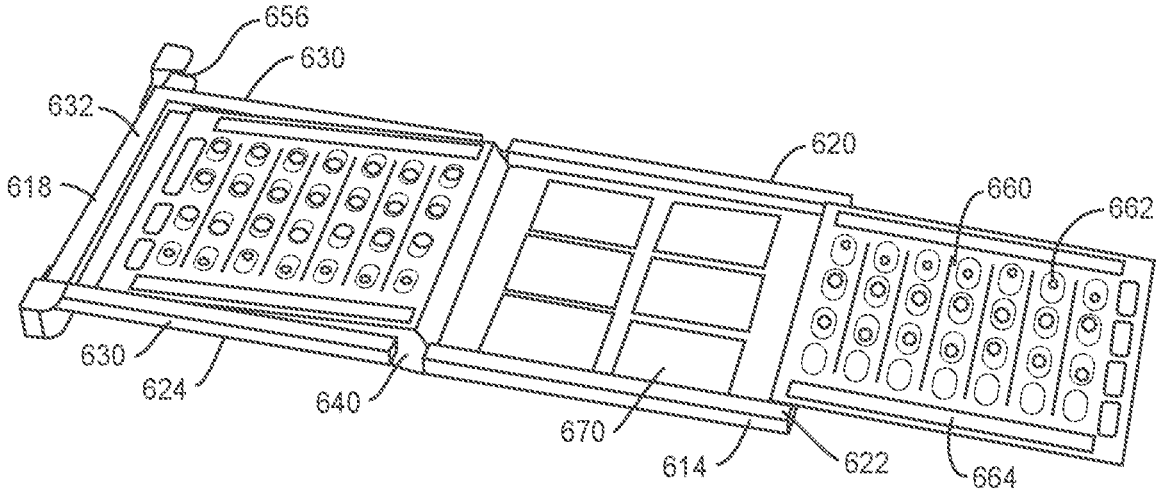
FIG. 34 is a perspective view of components of one embodiment of a system in accordance with the principles of the present disclosure.
Figure 35:
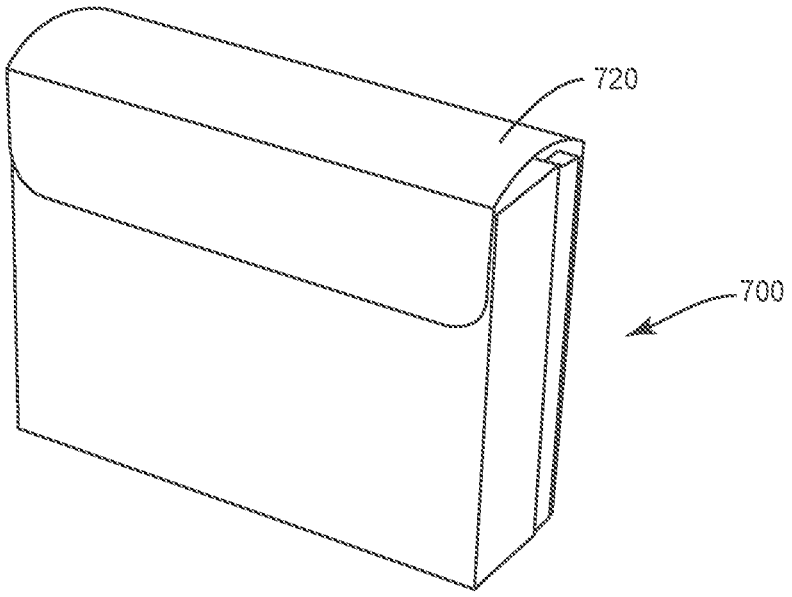
FIG. 35 is a perspective view of components of one embodiment of a system in accordance with the principles of the present disclosure.

In some embodiments, medicament dispensing container 612 includes a connecting portion, such as, for example, a spine 640. Spine 640 extends between pocket 614 and pocket 624 such that pocket 624 is pivotable relative to pocket 614. Pocket 624 is attached to spine 640 at an end opposite sidewall 628, and pocket 614 is attached to spine 640 at an end opposite sidewall 618. Pocket 624 is pivotable relative to pocket 614 between an open or non-locked configuration, such as, for example, a medication accessible configuration, as shown in FIG. 34, and a closed or locked configuration, such as, for example, a tamper resistant configuration, as shown in FIG. 32. In some embodiments, medicament dispensing container 612 is disposable in a closed, locked and non-tamper resistant configuration with a locking mechanism 650, as described herein.

In some embodiments, pocket 624 is rotatable relative to pocket 614 through an angular range of 0 through 360 degrees. In a closed configuration, as shown in FIG. 32, spine 640, sidewalls 618, 620, 628, 630, and sections 616, 626 define a substantially enclosed cavity configured for disposal of unit dose pages 660 and/or information inserts 670 such that pocket 624 and pocket 614 prevent access to contents of medicament dispensing container 612. In some embodiments, in a closed configuration, pocket 624 and pocket 614 provide a child-resistant medicament dispensing container. In an open configuration, as shown in FIG. 34, pocket 614 is rotated relative to pocket 624 such that medicament dispensing container 612 rests flatly on a surface to facilitate ease of access to the contents of the cavity of medicament dispensing container 612.

Medicament dispensing container 612 includes a mechanism configured to connect pocket 614 with pocket 624 for disposal of the components of medicament dispensing container 612 in a closed configuration. In some embodiments, pocket 614 and/or pocket 624 is provided with indicia, such as, for example, instructions to aid a user patient in use of medicament dispensing container 612. The instructions may be presented in the form of a graphic, such as, for example, a bulls eye, or text, such as, for example, "push here".

Medicament dispensing container 612 includes locking mechanism 650 comprising a slide 654, such as, for example, two slides 654, disposed on opposite sides of pockets 614, 624 at a corner defined by front walls 618, 628 and sidewalls 620, 630. Each slide 654 includes a male engagement portion, such as for example, a flange 656 configured to engage pocket 624. Pocket 624 includes an outer surface 642 that defines slots 658. Slots 658 extend a distance from sidewalls 620, 630 towards each other along front walls 618, 628. Slots 658 are configured to facilitate translation of flanges 656 such that slides 654 are translated, in the direction shown by arrows A in FIG. 33, to move medicament dispensing container 612 to an open or non-locked configuration, and slides 654 are translated, in the direction shown by arrows B in FIG. 32, to a closed or locked configuration, such as, for example, a tamper resistant configuration.

In some embodiments, locking mechanism 650 audibly clicks to indicate a locked position. In some embodiments, locking mechanism 650 is provided with instructions to aid a patient in use of medicament dispensing container 612. In some embodiments, the instructions may be presented in the form of a graphic, such as, for example, an arrow with a lock, or text, such as, for example, "slide to unlock". In some embodiments, the instructions may be printed on locking mechanism 650. Alternatively, in some embodiments, the instructions may be printed onto sidewall 618 adjacent locking mechanism 650.

Medicament dispensing container 612 comprises one or more unit dose pages 660, as shown in FIG. 34, which store and/or contain one or more medications, such as, for example, a dose of at least one medication. The dose of medication(s) is enclosed and sealed in a plurality of receptacles 662. In some embodiments, medicament dispensing container 612 includes a plurality of unit dose pages 660. In one embodiment, the plurality of unit dose pages 660 is disposed in a trifold configuration, as shown in FIG. 34. In some embodiments, each unit dose page 660 encloses a different medication such that each medication that is part of a patient's dosage regimen is organized on separate unit dose pages 660. In some embodiments, unit dose page 660 comprises receptacles 662 indicating a patient's daily dosage of medication held within unit dose page 660. In some embodiments, unit dose page 660 comprises indicia 664, disposed with and displayed from a predetermined area adjacent one or more receptacles 662, indicating information regarding the medication enclosed within receptacles 662.

Figure 36:
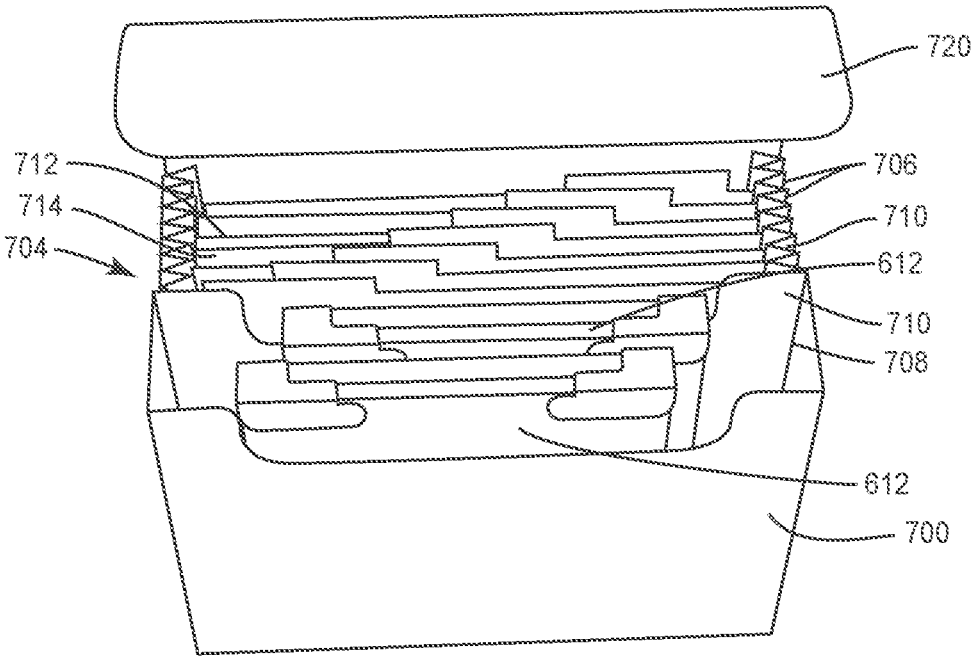
FIG. 36 is a perspective view of components of one embodiment of a system in accordance with the principles of the present disclosure.
Figure 37:
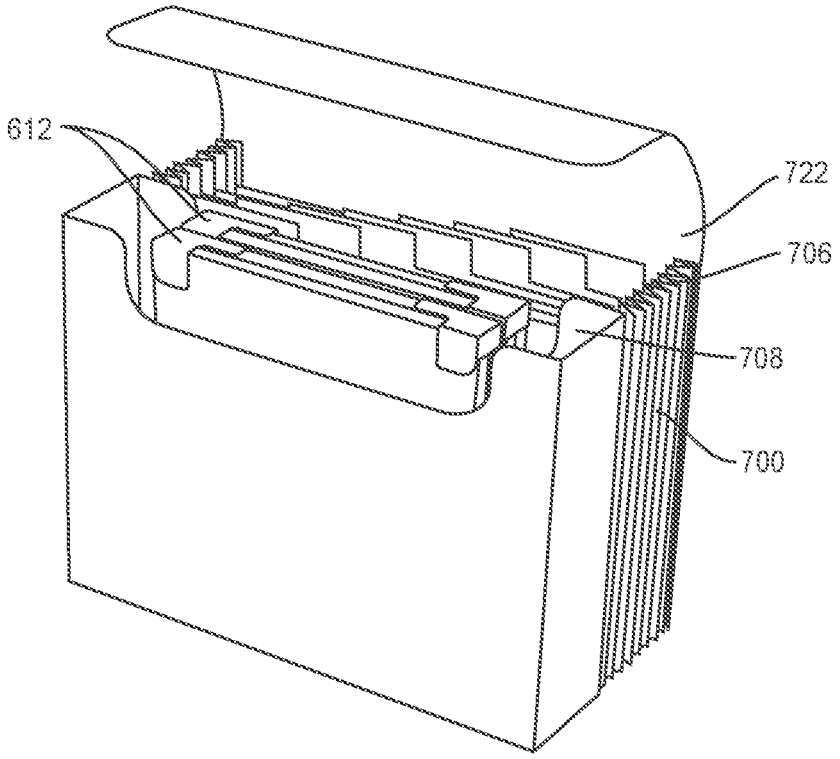
FIG. 37 is a perspective view of components of the system shown in FIG. 36.
Figure 38:
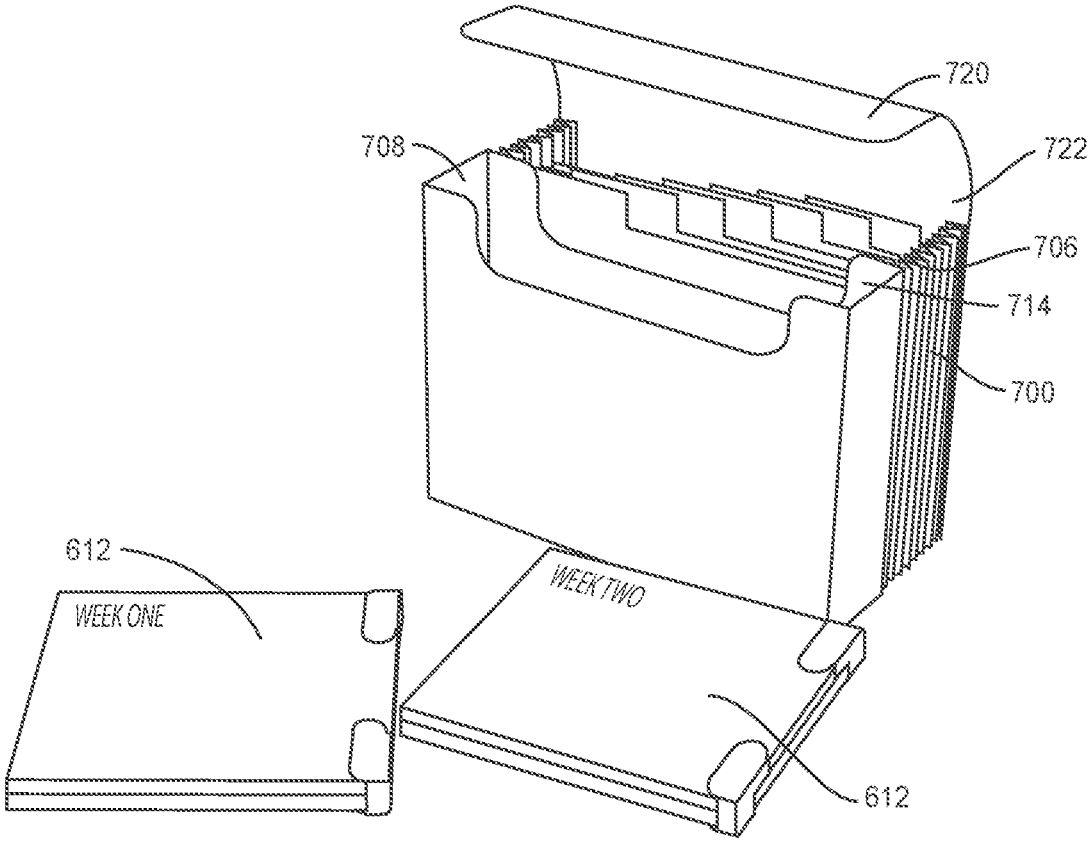
FIG. 38 is a perspective view of components of one embodiment of a system in accordance with the principles of the present disclosure.

In some embodiments, medicament dispensing container 612 includes a plurality of medicament dispensing containers 612, as shown in FIGS. 36-38, configured for disposal with a receptacle, such as, for example, an organizer 700. Organizer 700 is divided into sections 704. Sections 704 include compartments 706 and compartment 708 separated by partitions 710. Each compartment 706 includes a wall 712 and openings 714. In some embodiments, each compartment 706 is equally sized and configured. In some embodiments, compartment 708 is larger to store at least two medicament dispensing containers 612 in a top to bottom configuration to facilitate efficient storage of medicament dispensing containers, such as, for example, medicament dispensing containers 612. In some embodiments, organizer 700 is configured for disposal of medicament dispensing containers 612 in a linear orientation. In some embodiments, stack organizer 700 is configured for disposal of medicament dispensing containers 612 in a staggered, offset, row or column orientation.

In one embodiment, organizer 700 includes a folder flap 720 attached to organizer 700 at a connecting portion, such as, for example, a spine 722. Spine 722 is disposed such that flap 720 is pivotable relative to spine 722. Flap 720 is pivotable relative to organizer 700 between an open or non-locked configuration, such as, for example a medication accessible configuration, and a closed or locked configuration, such as, for example, a tamper resistant configuration, similar to that described herein.

Figure 39:
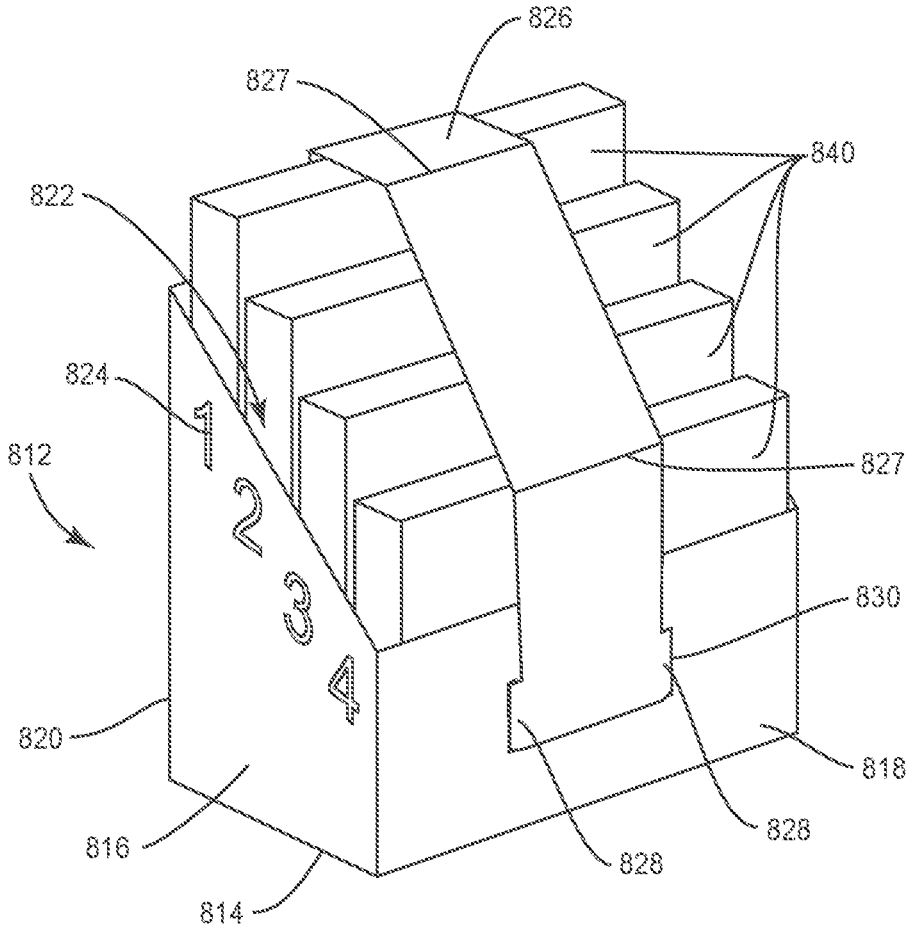
FIG. 39 is a perspective view of components of one embodiment of a system in accordance with the principles of the present disclosure.
Figure 40:
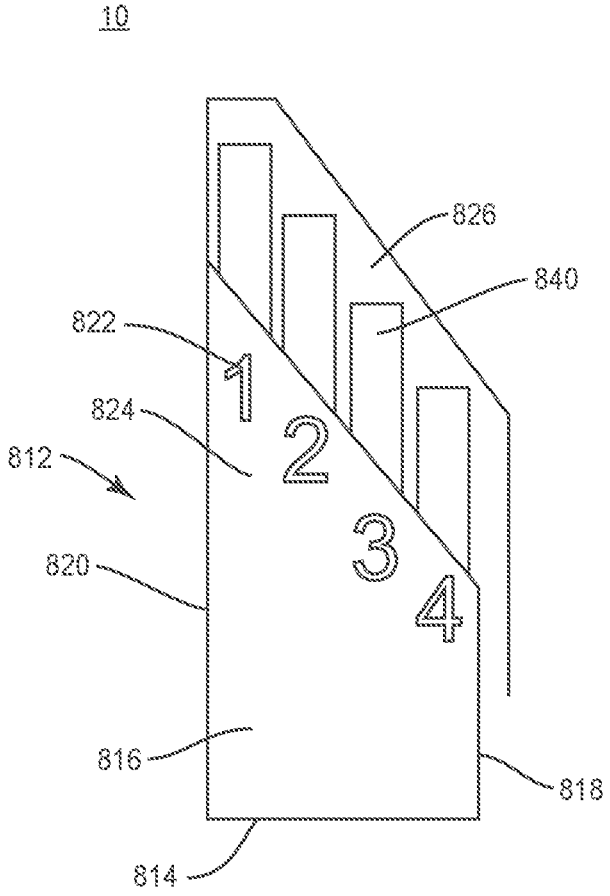
FIG. 40 is a side view of the components shown in FIG. 39.
Figure 41:
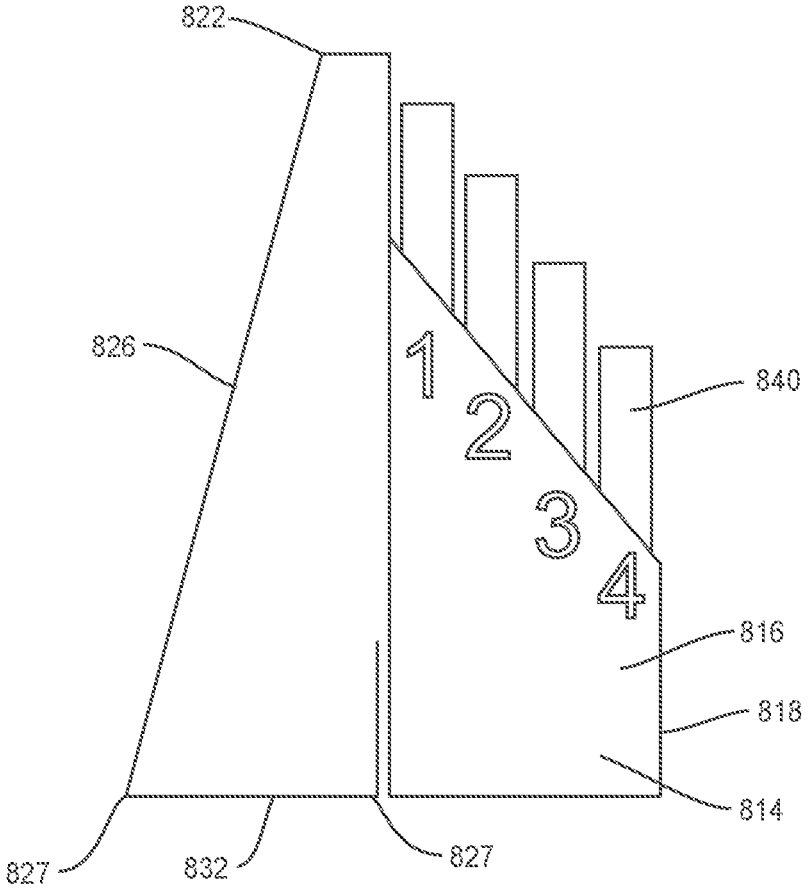
FIG. 41 is a side view of the components shown in FIG. 39.

In one embodiment, as shown in FIGS. 39-41, medicament dispensing system 10, similar to the systems and methods of use of medicament dispensing system 10 described herein, includes a medication packaging 812. Medication packaging 812 includes a bottom portion 814, a pair of oppositely positioned side walls 816, a front wall 818 and a rear wall 820. In one embodiment, medication packaging 812 is a foldable box in which portion 814 is formed from foldable portions of walls 816, 818, 820. Walls 816 are spaced apart from one another by a first distance, and walls 818, 820 are spaced apart from one another by a second distance. In one embodiment, the first distance is greater than the second distance such that walls 816, 818 have a rectangular cross-sectional configuration. In other embodiments, the first and second distances are equal such that walls 816, 818 have a square cross-sectional configuration. Portion 814 and walls 816, 818, 820 define a cavity 822. Cavity 822 is sized to receive medicaments stored in medication containers 840, as discussed herein, as shown in FIG. 41. In one embodiment, cavity 822 receives an insert having a step-like profile (not shown) to provide a base for containers 840. The insert provides bases of increasing height for consecutive containers 840 such that multiple containers 840 are visible to a user, as shown in FIGS. 39-41.

Wall 820 is taller than wall 818 to facilitate a patient's visibility of containers 840 held in cavity 822. Walls 816 extend between walls 820 and 818 such that walls 816 have a sloped profile. In one embodiment, walls 816 include indicia 824 to differentiate containers 840 held in cavity 822. In one embodiment, the indicia 824 include characters to identify corresponding containers 840. Indicia 824 are screen printed onto walls 816. In some embodiments, indicia 824 may be hand written.

In one embodiment, medication packaging 812 includes a retaining member, such as, for example, a strap 826. Strap 826 extends from wall 820 and is configured to retain containers 840 in cavity 822. Strap 826 includes tabs 828 sized to fit into slits 830 of wall 818, as discussed herein. In one embodiment, strap 826 is made from an elastomeric material or a fabric and is flexible along its body. In one embodiment, strap 826 is made from a rigid material, such as, for example, cardboard and is partially flexible. For example, strap 826 may include bends 827 to allow flexibility at certain portions. In some embodiments, bends 827 are spaced along strap 826 to form a predefined shape, such as a shape to conform to containers 840 held within cavity 822.

In some embodiments, strap 826 is movable between an unlocked configuration and a locked configuration. In the unlocked configuration, strap 826 is not engaged with medication packaging 812 such that containers 840 are readily accessible to a patient. In the locked configuration, tabs 828 are inserted into slits 830 to retain containers 840 in cavity 822. When moving to the locked configuration, strap 826 is rotated toward wall 818 until tabs 828 are aligned with slits 830. In some embodiments, tab 828 includes a length that is greater than the length of slit 830. As medication packaging 812 is moved between an unlocked configuration and a locked configuration, engagement of tabs 828 with slits 830 causes tabs 828 to bow and/or flex to fit into slits 830.

In one embodiment, strap 826 is configured to provide mechanical support for medication packaging 812 in the unlocked configuration. In one embodiment, as shown in FIG. 41, strap 826 is folded adjacent to wall 820 along bends 827 to define a support portion 832 of strap 826. Bends 827 are spaced such that support portion 832 lies flat on a surface top adjacent portion 814. Support portion 832 provides a wider base for medication packaging 812 to increase mechanical stability and prevent medication packaging 812 from being tipped.

In one embodiment, medicament dispensing system 10 includes at least one medication container 840 having an interior space to receive medications. Container 840 is movable between a closed configuration and a medication accessible configuration. Containers 840 include a stackable configuration to facilitate efficient storage of containers 840 with medication packaging 812. In some embodiments, container 840 is configured for disposal of medications in a linear and/or axial orientation. In some embodiments, container 840 is configured for disposal of medications in a staggered, offset, row or column orientation. In some embodiments, container 840 comprises indicia displaying information regarding the medication enclosed within the interior space.

Medication packaging 812 is portable such that the user/patient transports and/or carries medication packaging 812 upon discharge. Strap 826 is moved from a locked configuration, as shown in FIGS. 39 and 40, to an unlocked configuration, as shown in FIG. 41. Tabs 828 are bowed and/or flexed to disengage slits 830 on front wall 818. Strap 826 is rotated behind rear wall 820 and folded along creases 827 such that support portion 832 lies flat on a surface top adjacent to bottom portion 814 of medication packaging 812. The contents of cavity 822, which may include containers 840 and/or informational inserts, as described herein, are accessible to the user/patient, as shown in FIG. 41. The user/patient employs the components of medicament dispensing system 10, for example, following direction via indicia printed on containers 840 for administering dosage units from containers 840 to facilitate user/patient compliance with the medication regimen in connection with treatment for the myocardial infarction. Strap 826 is rotated back to the locked configuration such that medication packaging 812 is disposable in a child-tamper resistant, locked configuration, as shown in FIG. 39, for storage and subsequent use.

Figure 42:
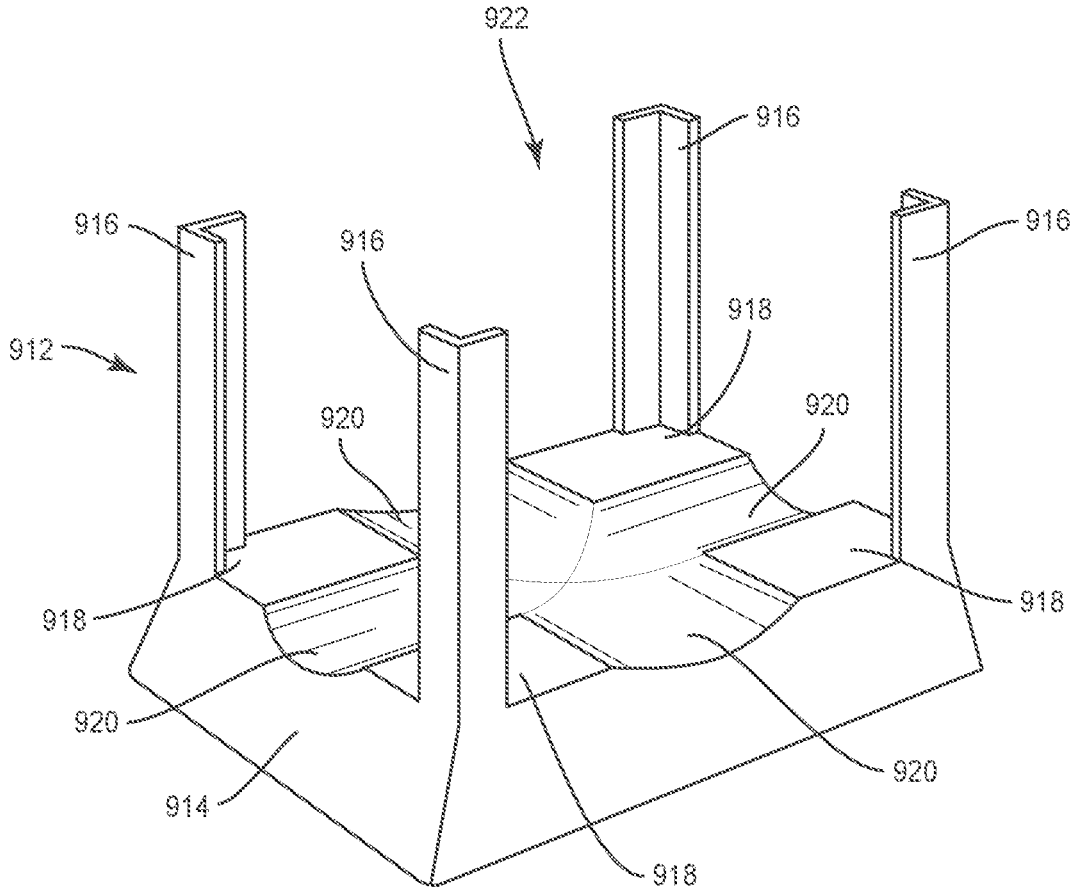
FIG. 42 is a perspective view of components of one embodiment of a system in accordance with the principles of the present disclosure.
Figure 43:
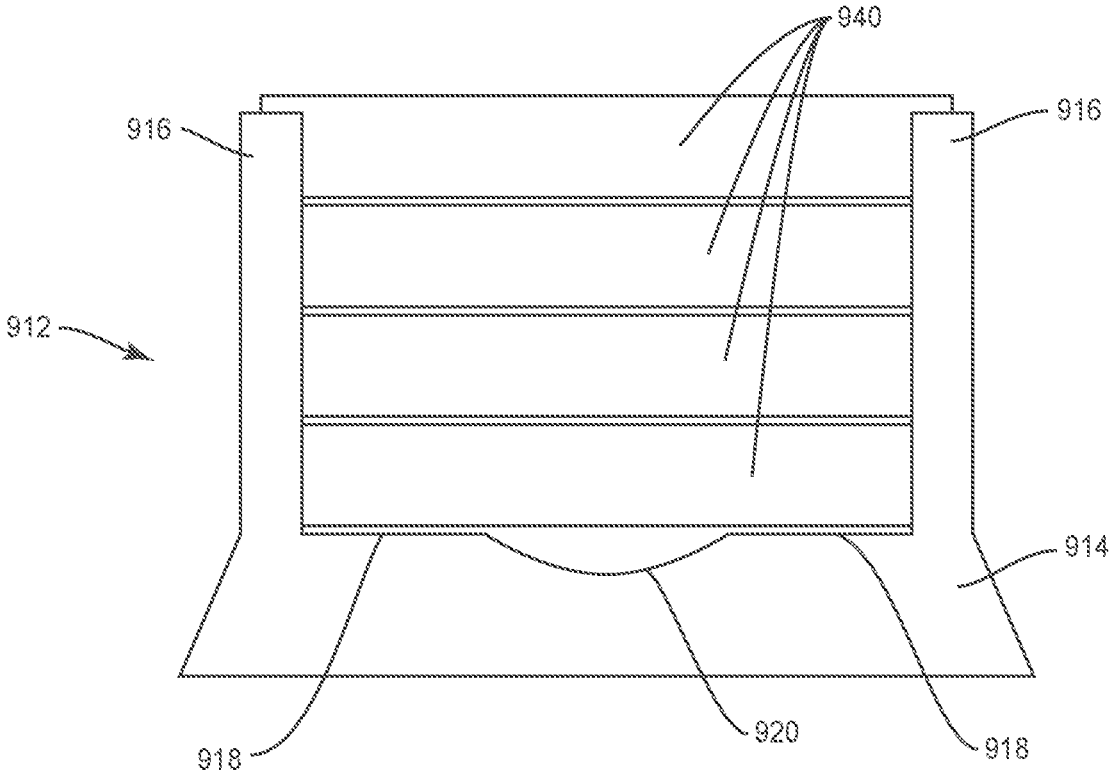
FIG. 43 is a side view of components of the system shown in FIG. 42.

In one embodiment, as shown in FIGS. 42 and 43, medicament dispensing system 10, similar to the systems and methods of use of medicament dispensing system 10 described herein, includes a medicament storage device, such as, for example, medication packaging 912. Medication packaging 912 includes a base portion 914 and columns 916. In one embodiment, base portion 914 defines a rectangular shape and columns 916 are positioned at each corner of base portion 914, as shown in FIG. 42. Columns 916 extend from each corner and along adjacent sides of base portion 914 to form a V-shaped cross section. Columns 916 and base portion 914 define a cavity 922. Cavity 922 is sized to receive medicaments stored in medication containers 940, similar to medication containers 840 described herein.

In one embodiment, base portion 914 includes flat surfaces 918. Surfaces 918 are positioned adjacent columns 916 and form a bottom surface to be disposed with a stack of containers 940. Base portion 914 includes a recess to allow a user to fit a finger under a container 940 disposed with surfaces 918 to remove one or more containers 940 from cavity 922. In one embodiment, as shown in FIG. 42, packaging 912 comprises two pairs of recesses 920 that extend between opposite sides of base portion 914. In other embodiments, recesses 920 may be variously configured. For example, in one embodiment, medication packaging 912 may comprise a single recess 920 or only one pair of oppositely positioned recesses 920.

In one embodiment, medicament dispensing system 10 includes at least one medication container 940. Container 940 has an interior space to receive medications, as described herein. Container 940 is movable between a closed configuration and a medication accessible configuration, similar to that described herein. Containers 940 include a stackable configuration to facilitate efficient storage of containers 940 in medication packaging 912. In some embodiments, container 940 is configured for disposal of medications in a linear and/or axial orientation. In some embodiments, container 940 is configured for disposal of medications in a staggered, offset, row or column orientation. In some embodiments, container 940 comprises indicia displaying information regarding the medication enclosed within the interior space.

Figure 44:
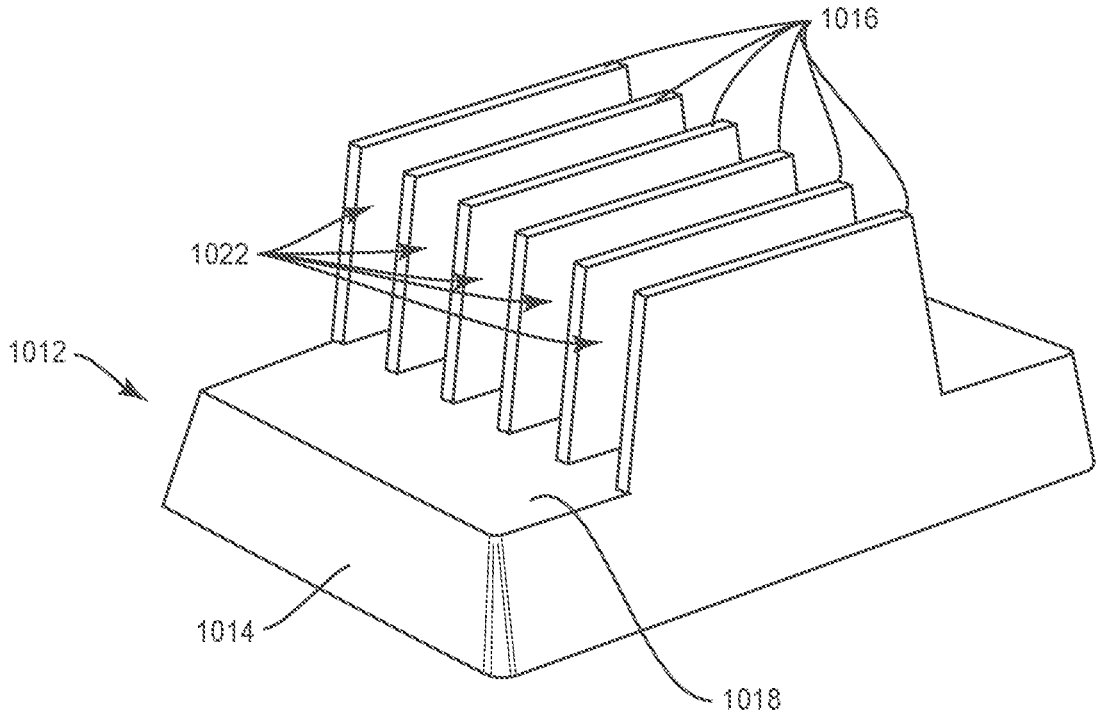
FIG. 44 is a perspective view of components of one embodiment of a system in accordance with the principles of the present disclosure.
Figure 45:
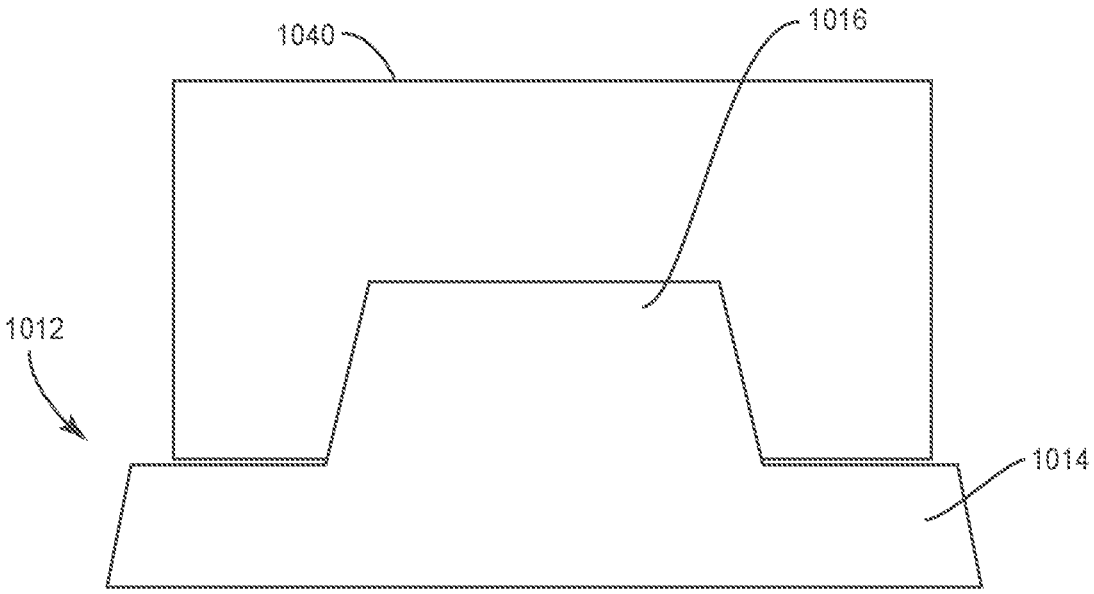
FIG. 45 is a side view of components of the system shown in FIG. 44.
Figure 46:
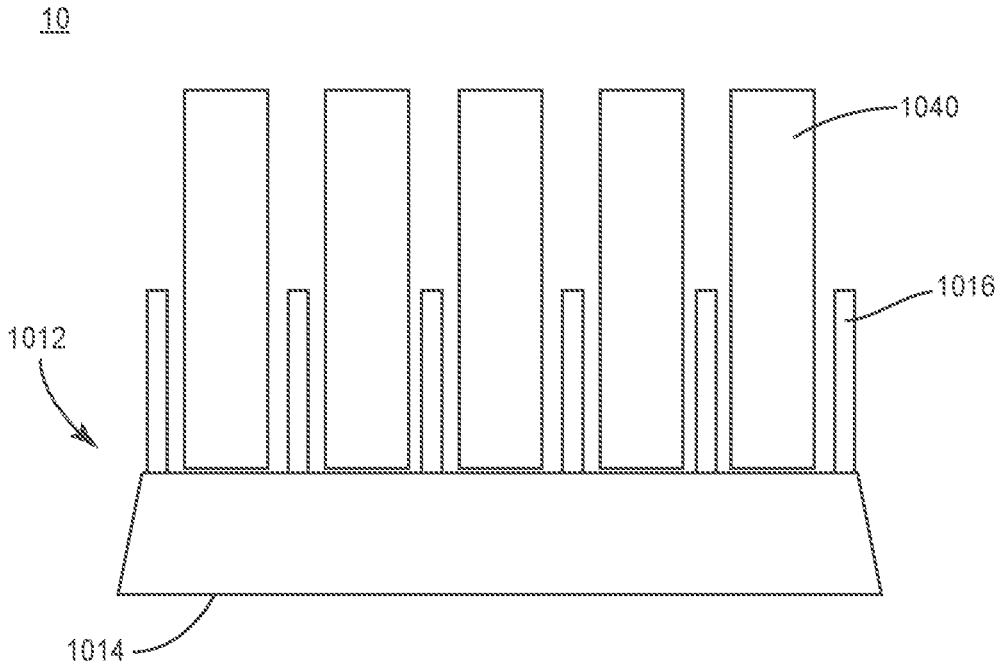
FIG. 46 is a side view of components of the system shown in FIG. 44.

In one embodiment, as shown in FIGS. 44-46, medicament dispensing system 10, similar to the systems and methods of use of medicament dispensing system 10 described herein, includes a medicament storage device, such as, for example, medication packaging 1012. Medication packaging 1012 includes a base portion 1014 and partitions 1016. In one embodiment, base portion 1014 defines a rectangular shape and includes a plurality of partitions 1016 extending from portion 1014, as shown in FIG. 44. Portion 1014 includes a surface 1018 disposed with a one or more medication containers 1040, similar to the medication containers described herein. Adjacent partitions 1016 extend parallel to one another to define a cavity 1022. Cavity 1022 is sized to receive medicaments stored in medication containers 1040, as discussed herein.

In one embodiment, medicament dispensing system 10 includes at least one medication container 1040. Container 1040 has an interior space to receive medications, similar to that described herein. Container 1040 is movable between a closed configuration and a medication accessible configuration, similar to that described herein. In some embodiments, containers 1040 are configured for disposal of medications in a linear and/or axial orientation. In some embodiments, containers 1040 are configured for disposal of medications in a staggered, offset, row or column orientation. In some embodiments, container 1040 comprises indicia displaying information regarding the medication enclosed within the interior space.

Figure 47:
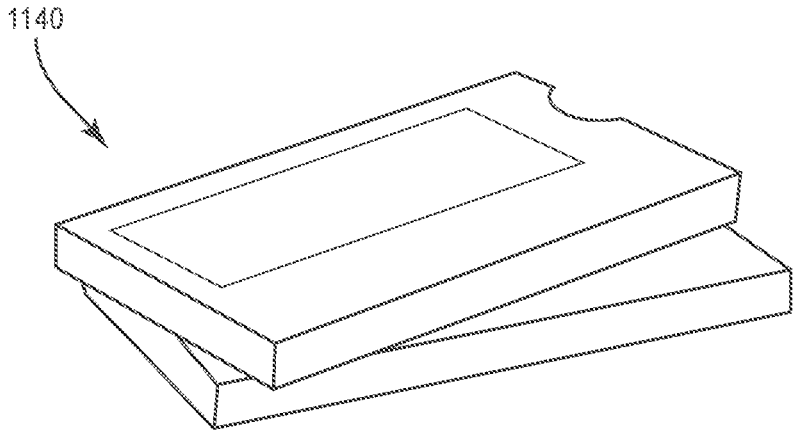
FIG. 47 is a perspective view of components of one embodiment of a system in accordance with the principles of the present disclosure.
Figure 48:
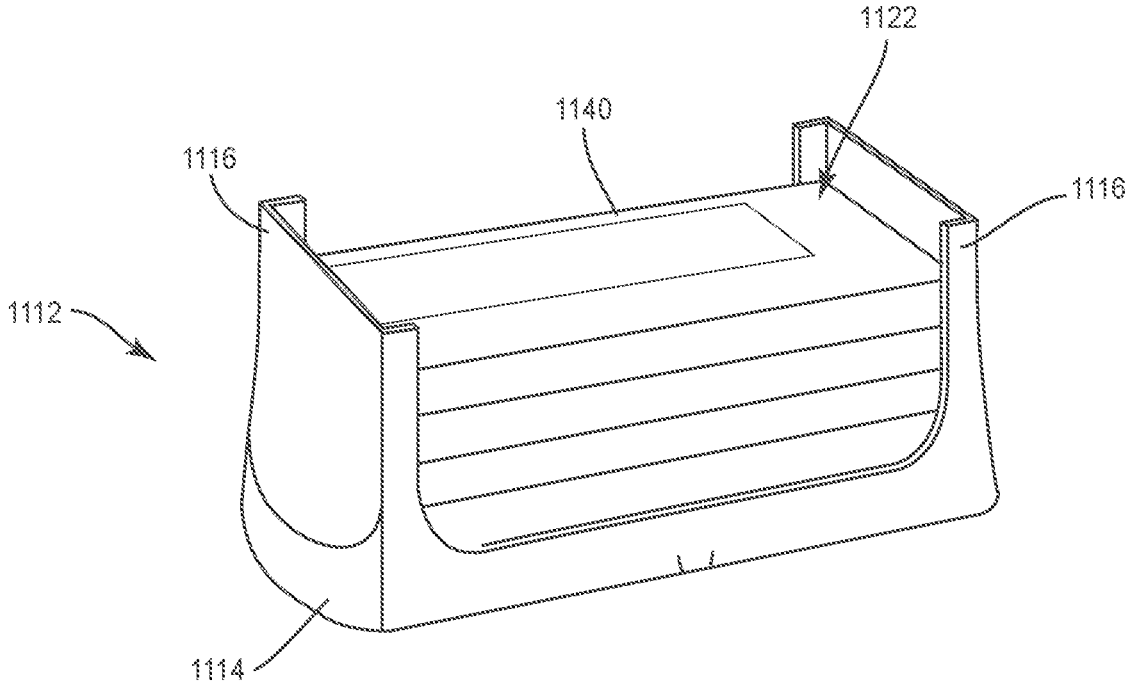
FIG. 48 is a perspective view of components of one embodiment of a system in accordance with the principles of the present disclosure.

In one embodiment, as shown in FIGS. 47 and 48, medicament dispensing system 10, similar to the systems and methods of use of medicament dispensing system 10 described herein, includes a medicament storage device, such as, for example, medication packaging 1112, similar to medication packaging described herein. Medication packaging 1112 includes a base portion 1114 and columns 1116 that define a cavity 1122. Cavity 1122 is sized to receive medicaments stored in medication containers 1140, similar to the medication containers described herein.

Figure 49:
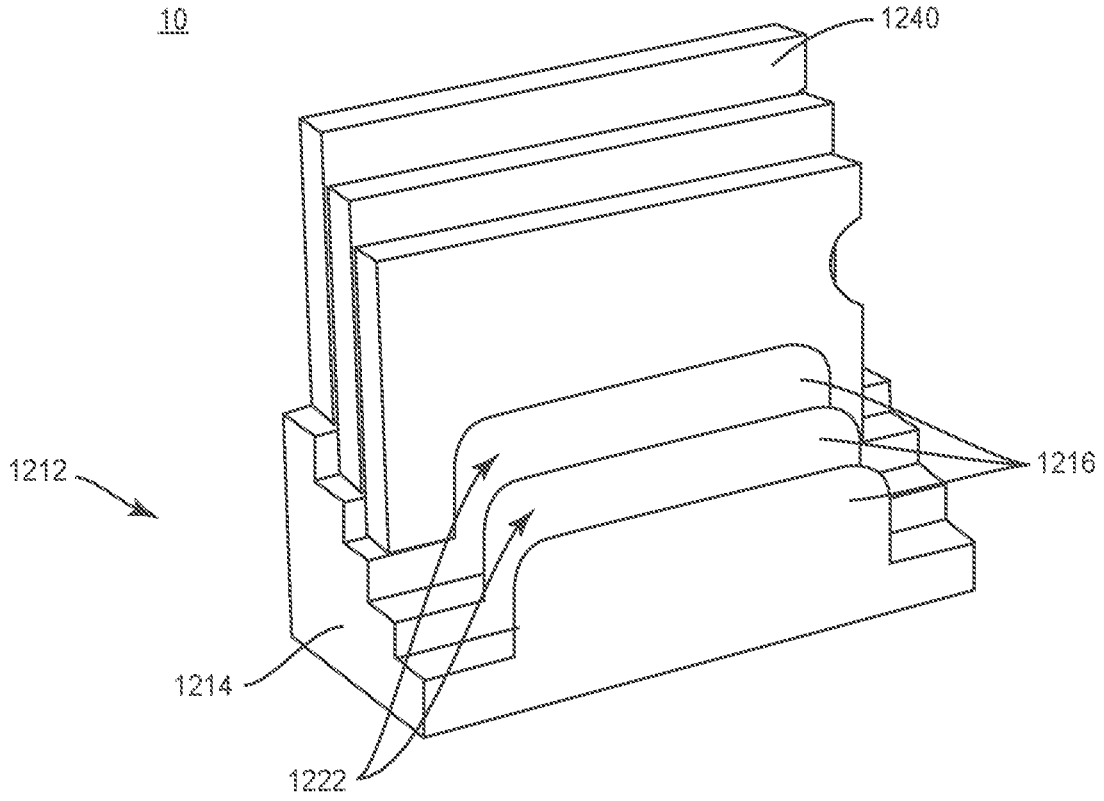
FIG. 49 is a perspective view of components of one embodiment of a system in accordance with the principles of the present disclosure.

In one embodiment, as shown in FIG. 49, medicament dispensing system 10, similar to the systems and methods of use of medicament dispensing system 10 described herein, includes a medicament storage device, such as, for example, medication packaging 1212, similar to the medication packaging described herein. Medication packaging 1212 includes a base portion 1214 and partitions 1216 that define cavities 1222. Cavities 1222 are sized to receive medicaments stored in medication containers 1240, similar to the medication containers described herein.

Figure 50:
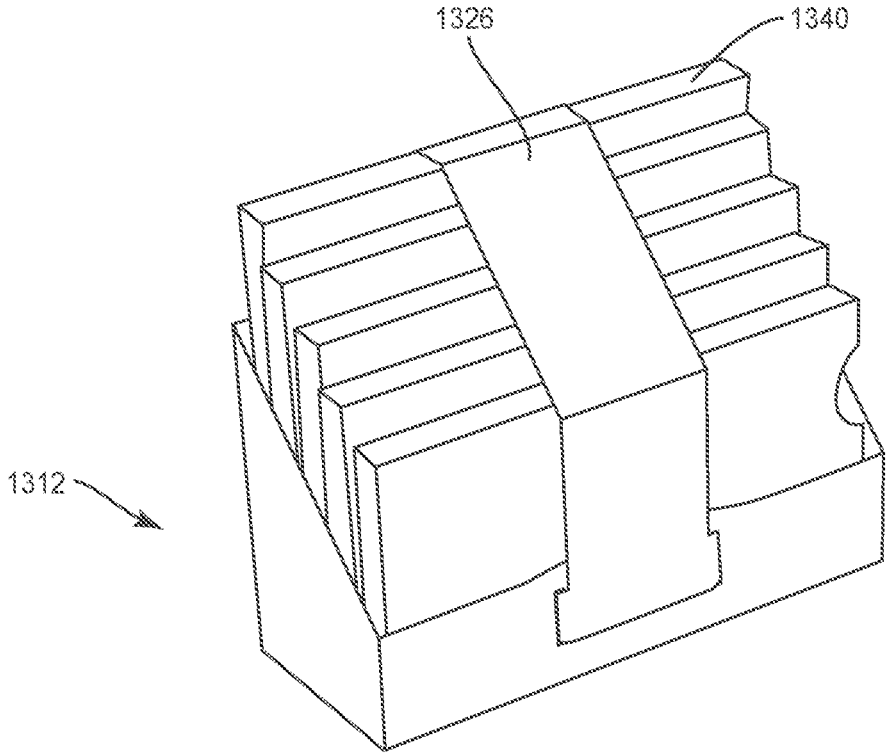
FIG. 50 is a perspective view of components of one embodiment of a system in accordance with the principles of the present disclosure.
Figure 51:
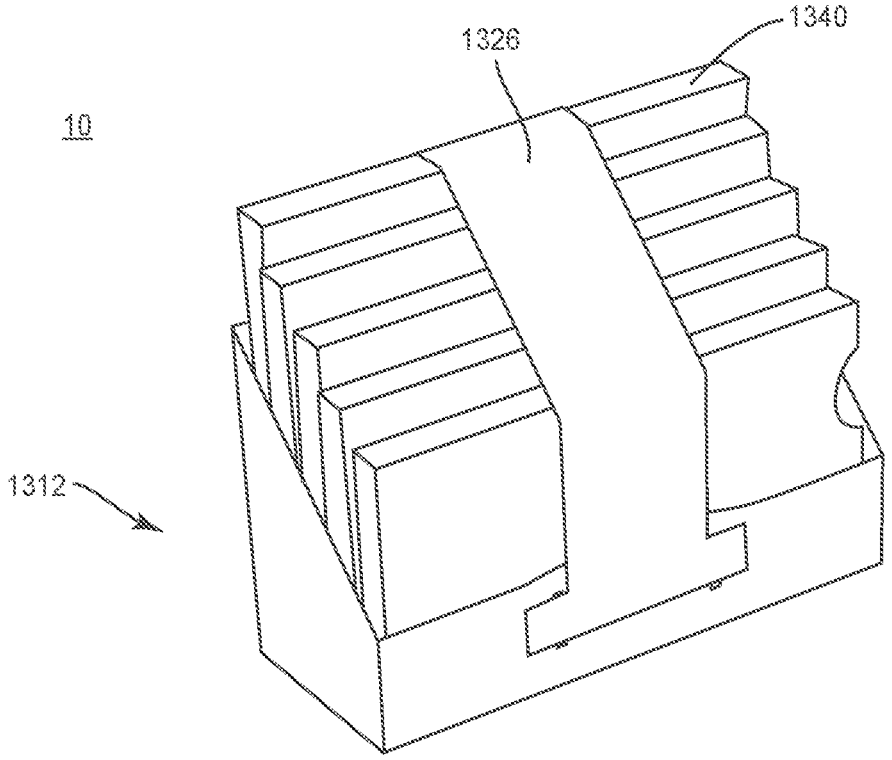
FIG. 51 is a perspective view of components of the system shown in FIG. 50.
Figure 52:
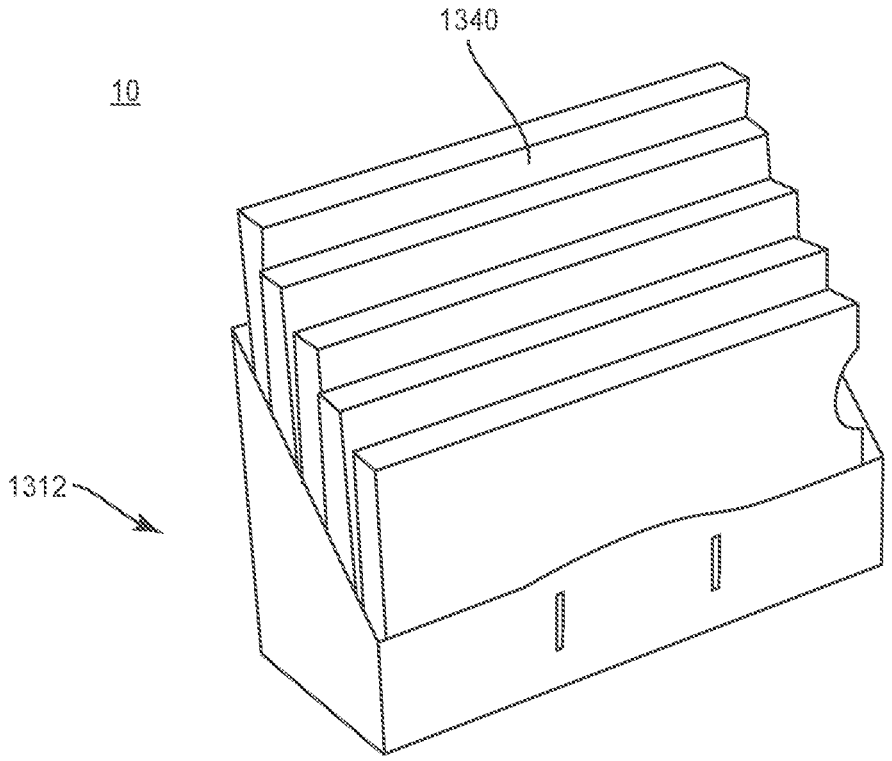
FIG. 52 is a perspective view of components of the system shown in FIG. 50.

In one embodiment, as shown in FIGS. 50-52, medicament dispensing system 10, similar to the systems and methods of use of medicament dispensing system 10 described herein, includes a medicament storage device, such as, for example, medication packaging 1312, similar to the medication packaging described herein. Medication packaging 1312 receives medicaments stored in medication containers 1340, similar to the medication containers described herein. Medication packaging 1312 includes a strap 1326, similar to the straps described herein.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A medicament dispensing container comprising: a first wall and a second wall defining a cavity therebetween; at least one member connected to at least one of the first and second walls and being disposable in the cavity, the at least one member defining at least one dose receptacle configured for disposal of at least one dose of at least one medication, the at least one member including indicia relating to a medication regimen comprising the at least one medication;

a cover disposed on top of the cavity enclosing the at least one member, the cover comprising a tab extending transversely from the cover into the cavity;

an aperture disposed on an interior side of the second wall such that a button disposed on the tab engages the aperture to form a tamper resistant configuration; and a knob aligning and extending along an exterior side of the second wall such that the knob is configured to slideably release the button from the aperture to form a medication accessible configuration.

2. The medicament dispensing container as recited in claim 1, further comprising a tamper-resistant feature which fixes the first wall and the second wall in the tamper resistant configuration.

3. The medicament dispensing container as recited in claim 2, wherein the lock includes a slide moveable between the medication accessible configuration and the tamper resistant configuration.

4. The medicament dispensing container as recited in claim 2, wherein the lock includes an audible indicator when moved into the tamper resistant configuration.

5. The medicament dispensing container as recited in claim 1, wherein the tabs are resiliently biased into engagement with the apertures.

6. The medicament dispensing container as recited in claim 1, further comprising indicia disposed on the first wall or the second wall providing information for moving the first wall and the second wall between the medication accessible configuration and the tamper resistant configuration.

7. The medicament dispensing container as recited in claim 1, wherein the first wall and the second wall are connected with a spine.

8. The medicament dispensing container as recited in claim 7, wherein the spine includes binder rings configured to connect the at least one member.

9. The medicament dispensing container as recited in claim 1, wherein the at least one member includes unit dose pages including one or more medications.

10. The medicament dispensing container as recited in claim 1, further comprising an information insert.

11. The medicament dispensing container as recited in claim 1, further comprising a container receptacle configured for disposal of a plurality of medicament dispensing containers.

12. The medicament dispensing container as recited in claim 11, wherein the container receptacle includes an organizer.

* * * * *